US008036557B2

(12) United States Patent
Kinouchi et al.

(10) Patent No.: US 8,036,557 B2
(45) Date of Patent: Oct. 11, 2011

(54) FIXING DEVICE, IMAGE FORMING APPARATUS, AND HEATING CONTROL METHOD FOR FIXING DEVICE

(75) Inventors: Satoshi Kinouchi, Tokyo-to (JP); Osamu Takagi, Tokyo-to (JP); Yoshinori Tsueda, Shizuoka-ken (JP); Toshihiro Sone, Kanagawa-ken (JP); Koichiro Saito, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 440 days.

(21) Appl. No.: 12/117,022

(22) Filed: May 8, 2008

(65) Prior Publication Data

US 2008/0285996 A1 Nov. 20, 2008

Related U.S. Application Data

(60) Provisional application No. 60/917,976, filed on May 15, 2007.

(30) Foreign Application Priority Data

Mar. 14, 2008 (JP) ..... 2008-065801

(51) Int. Cl.
*G03G 15/20* (2006.01)

(52) U.S. Cl. ..... 399/69

(58) Field of Classification Search ..... 399/33, 399/67, 69, 333, 334
See application file for complete search history.

(56) References Cited

U.S. PATENT DOCUMENTS

| | | | | |
|---|---|---|---|---|
| 2005/0063726 | A1 * | 3/2005 | Kinouchi et al. | 399/88 |
| 2006/0131301 | A1 * | 6/2006 | Ohta et al. | 219/619 |
| 2006/0216079 | A1 * | 9/2006 | Nanjo | 399/333 |

FOREIGN PATENT DOCUMENTS

| | | |
|---|---|---|
| JP | 11-327331 | 11/1999 |
| JP | 2000-250338 | 9/2000 |
| JP | 2001-125407 | 5/2001 |
| JP | 2004-151470 | 5/2004 |

* cited by examiner

*Primary Examiner* — David Gray
*Assistant Examiner* — Rodney Bonnette
(74) *Attorney, Agent, or Firm* — Turocy & Watson, LLP

(57) ABSTRACT

A fixing device includes a heat roller having a degaussing alloy material, an induction heating member for exciting the heat roller, an inverter circuit for giving power at a predetermined frequency to the induction heating member, and a control unit, and when driving at a first drive frequency and fixing small size sheets by continuous passing, a local temperature rise occurs at an end part of the heat roller, and the end part approaches the Curie temperature, and when impedance of the inverter circuit reduces and an excessive current flows in the circuit, the fixing device drives at a higher second drive frequency, thereby increases a resistance of the heat roller by an epidermal effect of magnetic flux, increases an apparent resistance of the inverter circuit, makes it possible to use a flowing current within a normal range, heating a central part of the heat roller, and continues the fixing.

24 Claims, 14 Drawing Sheets

T
T/2
T/2 t1
t2
t3 t1'
t2'
t3

FIXING DEVICE, IMAGE FORMING APPARATUS, AND HEATING CONTROL METHOD FOR FIXING DEVICE

CROSS-REFERENCE TO RELATED APPLICATION

This application is based upon and claims the benefit of priority from the prior U.S. Patent Application No. 60/917,976, filed on May 15, 2007, the entire contents of all of which are incorporated herein by reference.

This application is based upon and claims the benefit of priority from the prior Japanese Patent Application No. 2008-65801, filed on Mar. 14, 2008, the entire contents of which are incorporated herein by reference.

FIELD OF THE INVENTION

The present invention relates to a fixing device having a permeable heat generation material in which the Curie temperature is set at a predetermined value, an image forming apparatus having the fixing device, and a heating control method for the fixing device.

DESCRIPTION OF THE BACKGROUND

An image heating device (fixing device) for heating and fixing a toner image transferred onto a sheet of paper is disclosed in Japanese Patent Application Publication No. 2001-125407.

The fixing device described in Japanese Patent Application Publication No. 2001-125407 includes a heat roller having a high permeability in which the Curie temperature is set a predetermined value, a pressing roller for making contact with the heat roller, thereby forming a nip, an exciting coil for exciting the heat roller from the outside, an exciting circuit for driving the exciting coil, and a conductive material with a semicircular section which is arranged inside the heat roller, has a higher conductivity than that of the heat roller (that is, the electric resistance is low), and can be rotated. When the temperature of the heat roller approaches the Curie temperature, and the permeability is lowered, and the conductive material is rotated to the opposite position to the exciting coil, the magnetic flux passing through the heat roller approaching the Curie temperature penetrates into the internal conductive material. Here, by controlling the current to be supplied to the exciting coil constant using the exciting circuit, generation of heat is suppressed and the temperature of the heat roller is made stable.

However, in the above constitution, the exciting circuit controls the current to be supplied constant, though the heat roller and the electric resistance of the conductive material depend on the temperature, so that the power supplied by the exciting circuit is not controlled. Recently, there is an increasing demand for controlling appropriately the distribution of the supply power of the whole image forming apparatus, and if the power control is made unconditional, a problem may be caused. On the other hand, when intending to control the power constant, if the permeability of the heat roller is lowered, the effective magnetic flux does not stay in the heat roller and passes through it, thus the impedance of the entire exciting circuit is lowered, so that there is a fear that the current flowing through the exciting circuit may exceed the allowable current.

SUMMARY OF THE INVENTION

The present invention was developed with the foregoing in view and is intended to provide a fixing device for using a degaussing alloy as an electromagnetic induction heat generation member in a wide temperature zone and supplying stably power to the exciting member.

According to an aspect of the present invention, there is provided a fixing device comprising a permeable member having a predetermined thickness; an induction heating member configured to excite the permeable member to generate an eddy current in the permeable member; a current supply circuit configured to supply an AC current to the induction heating member; and a control unit, when temperatures of a first portion and a second portion of the permeable member are a first temperature lower than a temperature $T_{TH}$ conforming to the following formula:

$$d = \sqrt{\frac{2\rho}{\omega_1 \mu_{(T_{TH})}}}$$

where d: a thickness [m] of the permeable member,

ρ: a resistivity [Ω·m] of the permeable member, $\omega_1$: an angular frequency [rad/s] of a first drive frequency, and μ: a permeability [H/m] of the permeable member, configured to control so as to permit the current supply circuit to supply the AC current at the first drive frequency to the induction heating member, and when the temperature of the second portion of the permeable member excited at the first drive frequency is a second temperature higher than the temperature $T_{TH}$, to control so as to permit the current supply circuit to supply the AC current which conforms to the following formula:

$$d < \sqrt{\frac{2\rho}{\omega_2 \mu_{(T_2)}}}$$

where $\omega_2$: an angular frequency [rad/s] of a second drive frequency and flows at the second drive frequency higher than the first drive frequency to the induction heating member.

Further, according to an aspect of the present invention, there is provided an image forming apparatus comprising an image forming unit configured to form an image on a sheet; a permeable member having a predetermined thickness; an induction heating member configured to excite the permeable member to generate an eddy current in the permeable member; a current supply circuit configured to supply an AC current to the induction heating member; and a control unit, when temperatures of a first portion and a second portion of the permeable member are a first temperature lower than a temperature $T_{TH}$ conforming to the following formula:

$$d = \sqrt{\frac{2\rho}{\omega_1 \mu_{(T_{TH})}}}$$

where d: a thickness [m] of the permeable member,

ρ: a resistivity [Ω·m] of the permeable member, $\omega_1$: an angular frequency [rad/s] of a first drive frequency, and μ: a permeability [H/m] of the permeable member, configured to control so as to permit the current supply circuit to supply the AC current at the first drive frequency to the induction heating member, and when the temperature of the second portion of the permeable member excited at the first drive frequency is a second temperature higher than the temperature $T_{TH}$, to control so as to permit the current supply circuit to supply the AC current which conforms to the following formula:

$$d < \sqrt{\frac{2\rho}{\omega_2 \mu_{(T_2)}}}$$

where $\omega_2$: an angular frequency [rad/s] of the second drive frequency and flows at the second drive frequency higher than the first drive frequency to the induction heating member.

Furthermore, according to an aspect of the present invention, there is provided a heating control method for a fixing device including a permeable member having a predetermined thickness, an induction heating member configured to excite the permeable member to generate an eddy current in the permeable member, and a current supply circuit configured to supply an AC current to the induction heating member, comprising: supplying the AC current at a first drive frequency for the induction heating member to the current supply circuit when temperatures of a first portion and a second portion of the permeable member are a first temperature lower than a temperature $T_{TH}$ conforming to the following formula:

$$d = \sqrt{\frac{2\rho}{\omega_1 \mu_{(T_{TH})}}}$$

where d: a thickness [m] of the permeable member,

ρ: a resistivity [Ω·m] of the permeable member, $\omega_1$: an angular frequency [rad/s] of the first drive frequency, and μ: a permeability [H/m] of the permeable member; and supplying the AC current for the induction heating member which conforms to the following formula:

$$d < \sqrt{\frac{2\rho}{\omega_2 \mu_{(T_2)}}}$$

where $\omega_2$: the angular frequency [rad/s] of the second drive frequency and flows at the second drive frequency higher than the first drive frequency to the current supply circuit when the temperature of the second portion of the permeable member excited at the first drive frequency is a second temperature higher than the temperature $T_{TH}$.

DETAILED DESCRIPTION OF THE INVENTION

Hereinafter, the embodiments of the present invention will be explained with reference to the accompanying drawings. Further, prior to explanation, the short side of an A4 size sheet and the short side of an A3 size sheet are defined respectively as a width direction of the sheets and the long sides of the respective sheets are defined as a length direction of the sheets.

Figure 1:
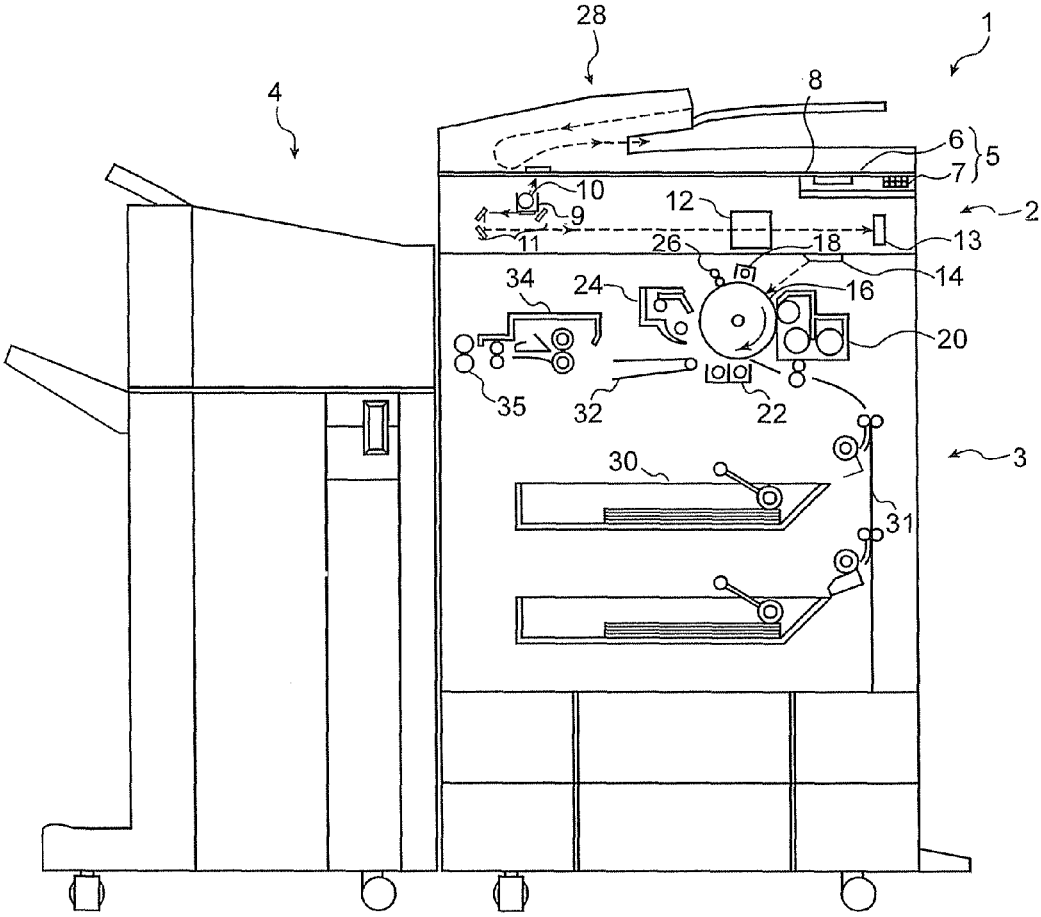
FIG. 1 is a schematic cross sectional view of the image forming apparatus.

FIG. 1 is a schematic block diagram of the image forming apparatus.

An image forming apparatus 1 includes an image reading unit 2 for reading an image to be read and an image forming unit 3 for forming an image. Further, on the upper part of the image forming apparatus 1, an operation panel 5 having a display unit of a touch panel type and various operation keys 7 is installed.

The operation keys of the operation panel 5, for example, have a ten-key pad, a reset key, a stop key, and a start key. Further, the display unit 6 inputs various processes such as the sheet size, number of copies, print density setting, and binding process.

The image reading unit 2 includes a permeable document table 8, a carriage 9, an exposure lamp 10, a reflection mirror 11, an imaging lens for converging reflected light, and a CCD (charge coupled device) 13 for fetching the reflected light and converting image information by light to an analog signal.

The image forming unit 3 includes a photo conductor 16, a laser unit 14 for forming an electrostatic latent image on the photo conductor 16, chargers 18 sequentially arranged around the photo conductor 16, a developing device 20, a transfer device 22, a cleaner 24, and a charge elimination lamp 26.

If light is applied to a document placed on the document table 8 or a document sent by an automatic document feeder 28 from underneath the document table 8 by the exposure means having the carriage 9 and the exposure lamp 10 installed on the carriage 9, the reflect light from the document is induced by the reflection mirror 11 and is converged by the imaging lens 12, and a reflected light image is projected to the CCD 13. The image information fetched by the CCD 13 is outputted as an analog signal, then is converted to a digital signal, is image-processed, and then is transmitted to the laser unit 14.

If the image forming unit 3 starts image formation, the charger 18 supplies a charge to the outer peripheral surface of the rotating photo conductor 16. Onto the outer peripheral surface of the photo conductor 16 which is charged at a uniform potential in the axial direction by the charger 18, according to the image information transmitted from the CCD 13, a laser beam is irradiated from the laser unit 14. If an electrostatic latent image corresponding to the image information of the document is formed and preserved on the outer peripheral surface of the photo conductor 16 by the irradiation of the laser beam, a developer (for example, toner) is supplied onto the outer peripheral surface of the photo conductor 16 by the developing device 20 and the electrostatic latent image is converted to a toner image.

The developing device 20 has a developing roller installed rotatably and if the developing roller is arranged and rotated opposite to the photo conductor 16, toner is supplied to the photo conductor 16. If a toner image is formed on the outer peripheral surface of the photo conductor 16, onto a sheet conveyed from a sheet supply device 30 via a sheet conveying path 31, the toner image is electrostatically transferred by the transfer device 22. Further, the toner remaining on the photo conductor 16 without transferred is removed by the cleaner 24 positioned on the downstream side of the transfer device 22 in the rotational direction of the photo conductor 16. Furthermore, the residual electric charge of the outer peripheral surface of the photo conductor 16 is eliminated by the charge elimination lamp 26.

On the other hand, the sheet onto which the toner image is transferred is conveyed to a fixing device 34 via a conveyor belt 32 and the toner image transferred onto the sheet is fixed on the sheet by the fixing device 34. The sheet finishing image formation since the toner image is fixed is ejected from the image forming apparatus 1 by an outlet roller 35 and is sent to a sheet post-processing apparatus 4. The sheet post-processing apparatus 4 post-processes the sheet conveyed from the image forming apparatus 1 according to an input instruction from the operation panel of the image forming apparatus 1 or a processing instruction from a personal computer (PC) and can use well-known arts including the post-processing apparatus described in Japanese Patent Application Publication No. 2007-76862. Further, the sheet mentioned above, for example, is ordinary paper, a paper board, thin paper, glossy paper, or an OH sheet.

On the other hand, the toner remaining on the photo conductor 16 without transferred is removed by the cleaner 24 positioned on the downstream side of the transfer device 22 in the rotational direction of the photo conductor 16 and furthermore, the residual electric charge of the outer peripheral surface of the photo conductor 16 is eliminated by the charge elimination lamp 26.

Figure 2:
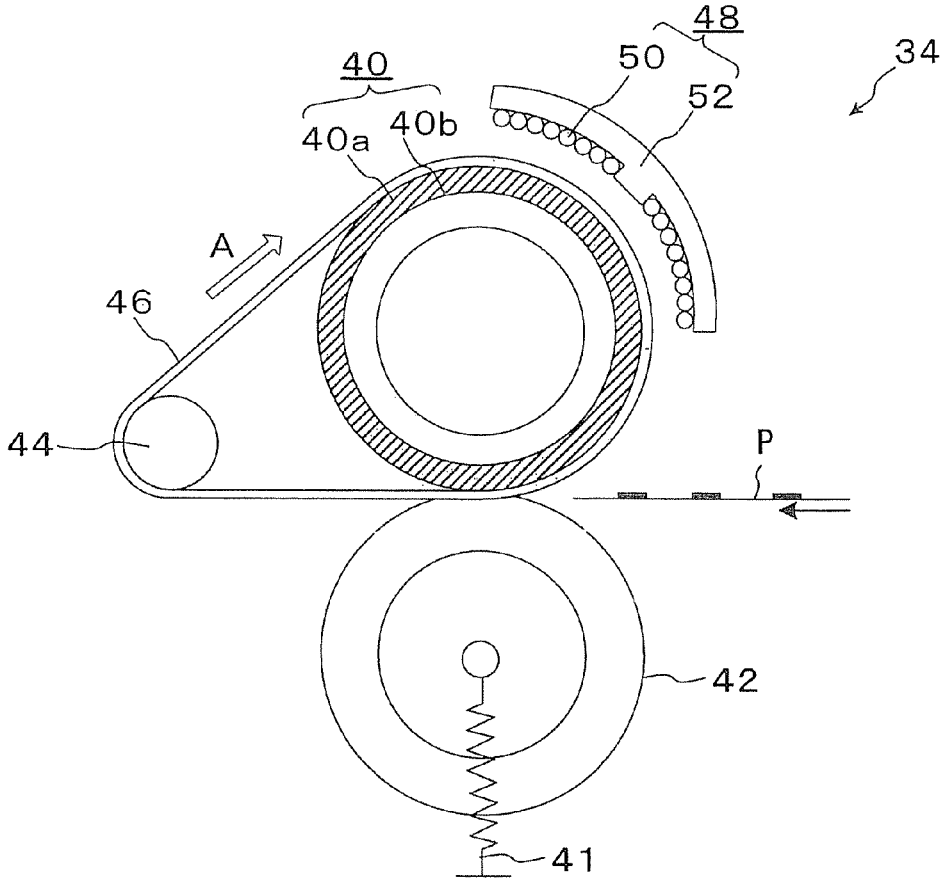
FIG. 2 is a schematic cross sectional view of the fixing device.

Next, the fixing device 34 will be described in detail. FIG. 2 is a schematic cross sectional view of the fixing device.

The fixing device 34 includes a heat roller 40 which is a heat member, a pressing roller (pressing member) 42 for pressurizing the heat roller 40 and forming a nip portion, a tension roller 44 arranged on the downstream side of the heat roller 40 in the sheet conveying direction, a belt 46 which is stretched between the heat roller 40 and the tension roller 44 at predetermined tension and is rotated in the direction of an arrow A, and an induction heating member 48 for exciting the heat roller 40.

The heat roller 40 includes a permeable degaussing alloy material 40*a* with a diameter of 40 mm and a thickness of 0.5 mm and a conductive material 40*b*. Further, in this embodiment, the degaussing alloy material 40*a* is composed of a composite alloy of iron, nickel, and chromium and is adjusted so that the Curie temperature which is a transition point temperature when the ferromagnetism is moved to the paramagnetism becomes a control temperature. Here, the Curie temperature Tc of the degaussing alloy material 40*a* of the heat roller 40, for example, is defined as 220% which is higher than the fixing control temperature (hereinafter, referred to as the fixing temperature) 180° C. by 40° C.

The pressing roller 42 has a diameter of 40 mm, is composed of heat resistant resin or rubber with a thickness of 2 mm such as silicone rubber, fluorine rubber, or fluorine resin around the core bar, and is pressurized to the heat, roller 40 across the belt 46 by a pressing spring 41, thereby forms a fixed nip width. Therefore, this embodiment has a structure that the heat roller 40 does not make direct contact with a sheet. Further, the outer peripheral surface of the pressing roller 42, in order to increase the wear resistance and the releasability of a sheet, may be coated with resin such as PFA (perfluoro alkoxyl alkane) or PTFE (poly tetra fluoro ethyline).

The tension roller 44 is a roller made of ceramics with a diameter of 15 mm and a thickness of 0.5 mm. The tension roller 44 permits the belt 46 to travel together with the heat roller 40. Further, the tension roller 44 may use additionally iron, SUS (stainless used steel) 430, SUS 304, other resins, a heat pipe which is a heat conduction element, or a combination thereof.

The belt 46 is an endless belt using a base with a thickness of 50 μm of polyimide, which is composed of an elastic layer of silicone rubber with a thickness of 300 μm outside thereof and a release layer with a thickness of 40 μm of PFA or PTF on the outermost periphery.

The induction heating member 48 includes an exciting coil 50 and a core member 52 and is arranged almost through the length of the heat roller 40 in the direction of the rotary shaft along the outer periphery of the heat roller 40.

The exciting coil 50 has a litz wire composed of several bundled covered copper wires with a wire diameter of 0.5 mm. Further, in this embodiment, 16 wires are bundled and the covered wires of the exciting coil 50 are made of heat-resistant polyamide-imide. Further, the core member 52 can use ferrite or permalloy.

A high-frequency current is impressed to the exciting coil 50 from the current supply circuit to generate magnetic flux, thus the heat roller 40 is heated. In this case, to make the temperature distribution of the entire roller uniform, the heat roller 40 is rotated, thus a fixed quantity of heat is given to the entire peripheral surface of the roller. Further, the pressing roller 42, tension roller 44, and belt 46 are rotated in accordance with the rotation of the heat roller 40.

When the surface temperature of the heat roller 40 reaches the fixing temperature, the image formation is started, and the sheet P is conveyed in the direction of the arrow B and passes through the nip portion between the pressing roller 42 and the belt 46 in the pressurized state, thus the toner on the sheet P is fixed.

Figure 3:
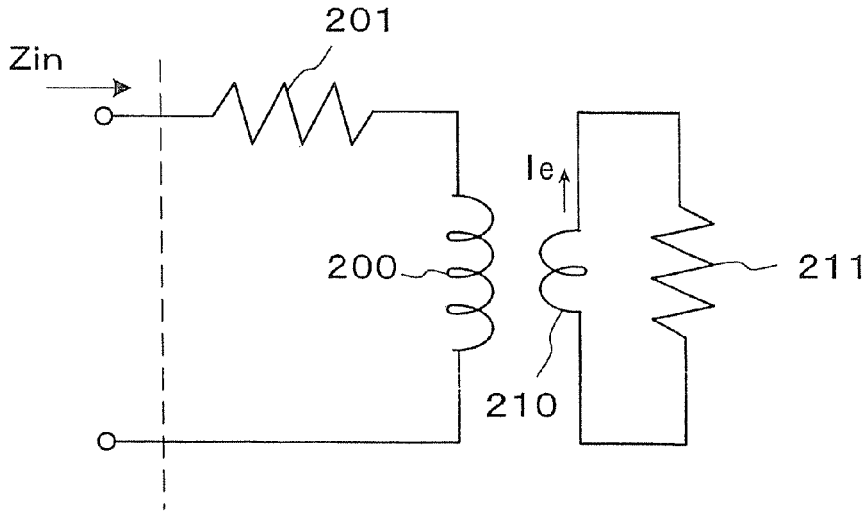
FIG. 3 is a circuit diagram for explaining the principle of induction heating.

Here, the principle of the induction heating of the heat roller 40 will be explained. In FIG. 3, a simple model for explaining the electric characteristic of the heat roller 40 is shown. As a model corresponding to the exciting coil 50, a primary coil 200 and a primary resistance 201 for expressing a loss of the exciting coil 50 form a series circuit. Further, as a model of an excited material corresponding to the heat roller 40, a secondary coil 210 and a load resistance 211 for expressing the resistance thereof form a series closed circuit.

In the primary coil 200, a high-frequency current is impressed from the current supply circuit, thus a high-frequency magnetic field is generated. In the secondary coil 210, so as to generate magnetic flux in the direction of preventing the magnetic flux of the magnetic field from change, an eddy current Ie is generated.

The eddy current Ie is concentrated and flows on the surface of the excited material on the side of the primary coil 200 due to the epidermal effect. Therefore, the excited material generates heat at power proportional to an epidermal resistance Rs.

Here, assuming the angular frequency of the high-frequency current of the circuit as ω [rad/s], the frequency as f [Hz], the permeability of the excited material as μ [H/m], the relative permeability as μr and the load resistance 211 of the excited material as ρ [Ω·m], an epidermal depth δ for indicating the flowing depth of a current with a size of 1/e for the current concentrating and flowing on the surface and the epidermal resistance Rs are generally expressed by Formula 1 and Formula 2.

[Formula 1]

$$\delta = \sqrt{\frac{2\rho}{\omega\mu}} = 503\sqrt{\frac{\rho}{\mu_r f}} \qquad \text{Formula 1}$$

[Formula 2]

$$R_S = \frac{\rho}{\delta} = \sqrt{\frac{\omega\mu\rho}{2}} \qquad \text{Formula 2}$$

Further, the power generated in the excited material is expressed as follows:

[Formula 3]

$$W = R_S \cdot Ie^2 \qquad \text{Formula 3}$$

Therefore, to increase the heat release value of the excited material, it is desirable to increase the eddy current Ie or increase the epidermal resistance Rs. Further, from the above formula, it may be said that the epidermal resistance Rs can be increased by increasing the frequency of the AC current impressed to the primary coil 200 or by using a highly permeable member or a member at a high load resistance 211 as an excited material.

Further, in FIG. 3, an input impedance $Z_{in}$ of the current supply circuit for supplying the AC current to the primary coil 200 is generally expressed by Formula 4. Here, K indicates a constant depending on the shapes of the primary coil 200 and excited material, and n indicates the number of turns of the primary coil 200, and Rc indicates the primary loss resistance 201.

[Formula 4]

$$Z_{in} = K \cdot n^2 \cdot Rs + R_C \qquad \text{Formula 4}$$

Therefore, it may be said that the input impedance $Z_{in}$ which is the resistance of the current supply circuit is greatly influenced by the epidermal resistance Rs of the excited material. For example, if the epidermal depth δ is increased by using an excited material having a low permeability μ or an excited material having a low resistivity ρ, the epidermal resistance Rs is reduced, so that the input impedance $Z_{in}$ is reduced.

Figure 4:
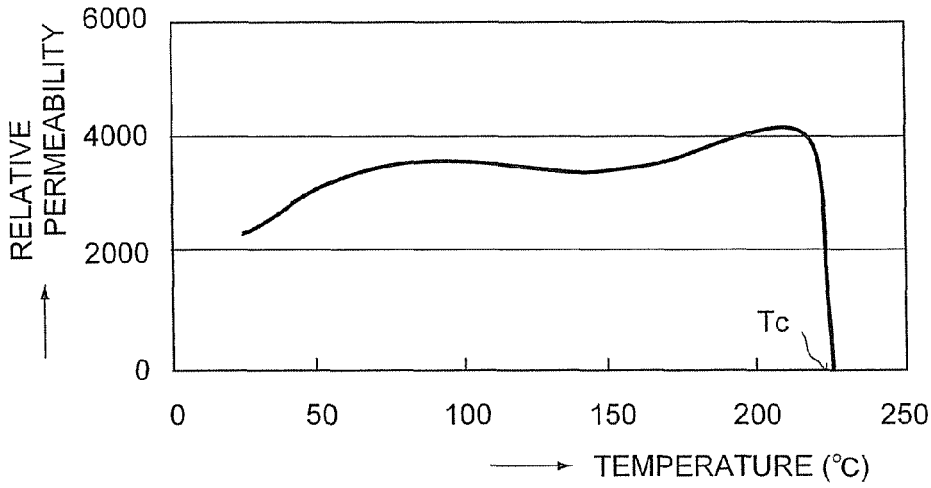
FIG. 4 is a graph showing the relationship between the temperature of the heat roller and the relative permeability.

Further, FIG. 4 shows an example of the graph showing the relationship between the temperature of the degaussing alloy material 40*a* of the heat roller 40 in which the Curie temperature Tc is set at 220° C. and the relative permeability. A relative permeability μr is expressed by a ratio μr=μ/μ0 to a permeability μ0 (μ0=4π×10E−7 [H/m]) in a vacuum and it is nondimensional. Generally, the degaussing alloy material 40*a* which is a ferromagnetic material moves from the ferromagnetism to the paramagnetism with the Curie temperature Tc, which is the transition point temperature, bounded by. When the temperature rises close to the Curie temperature Tc, the relative permeability μr of the degaussing alloy material 40*a* lowers suddenly and when the temperature is the Curie temperature Tc or higher, it lowers to an almost same value as the permeability of air.

Here, as shown in FIG. 4, the permeability μ is a function of a temperature T, so that from Formula 1, the epidermal depth δ is expressed by the following formula.

[Formula 5]

$$\delta = \sqrt{\frac{2\rho}{\omega\mu_{(T)}}} = 503\sqrt{\frac{\rho}{\mu_{r(T)} f}} \qquad \text{Formula 5}$$

Therefore, if the permeability μ is lowered at a certain temperature T or higher, the epidermal depth δ is increased.

Figure 5:
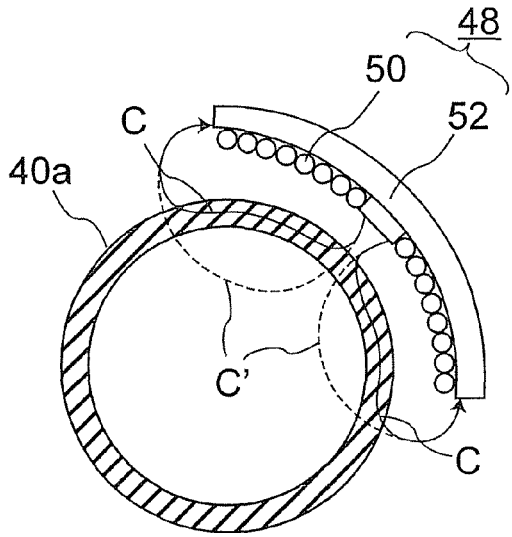
FIG. 5 is a schematic cross sectional view for explaining the flow of the magnetic flux of the fixing device.

For example, when the heat roller 40 is at a temperature lower than the Curie temperature Tc and has a high permeability, the magnetism easily passes through the inside of the degaussing alloy material 40*a*, so that as shown by the arrow C in FIG. 5, the magnetic flux generated from the induction heating member 48 penetrates into the degaussing alloy material 40*a* of the heat roller 40. On the other hand, when the temperature of the heat roller 40 becomes close to the Curie temperature Tc or the Curie temperature Tc or higher and the permeability μ is lowered, as shown by the arrow C', the magnetic flux generated from the induction heating member 48 passes through the heat roller 40. Further, in the neighborhood of a temperature lower than the Curie temperature, the magnetic flux passes in the directions of the arrows C and C'.

As mentioned above, if the permeability μ is lowered, as clearly shown in Formulas 2 and 5, the epidermal depth δ is increased and the epidermal resistance Rs is reduced. Further, the magnetic flux C passing the inside of the degaussing alloy material 40*a* is reduced and the eddy current Ie generated inside the heat roller 40 is reduced. As a result, the heat release value of the heat roller 40 is reduced.

Here, a case of continuous passing of small size sheets such as A4-R size sheets or B5 size sheets will be considered.

Figure 6:
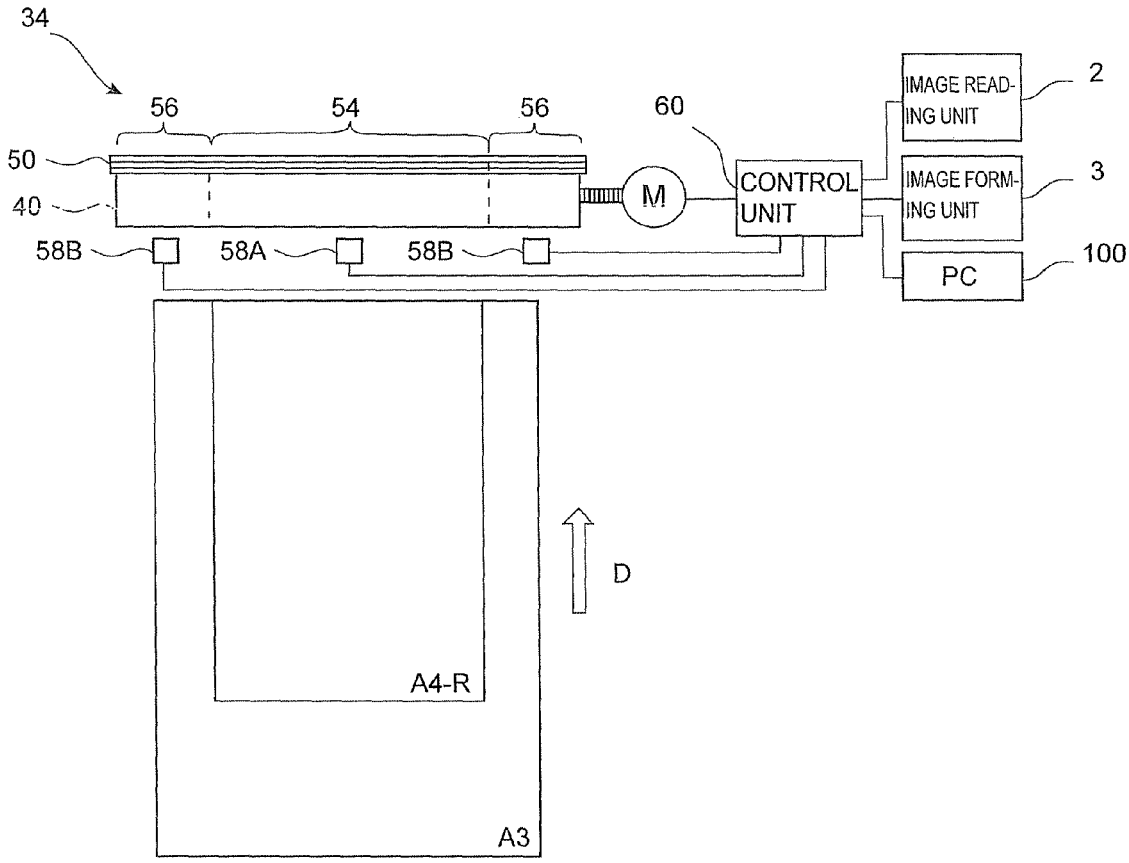
FIG. 6 is a schematic view showing a correspondence of the heat roller to the size of passing sheets.

As shown in FIG. 6, the part corresponding to the width direction of a small size sheet where the center of the heat roller 40 crosses the conveying direction D of the sheet is assumed as a central part (first part) 54 and the part of the heat roller 40 which can respond to a large size sheet such as an A3 size sheet and is different from the central part 54 is assumed as an end part (second part) 56. Further, sheets may pass referenced from the end of the heat roller 40. Further, numerals 58A and 58B indicate non-contact temperature sensors (temperature detection members) of a thermopile type for respectively detecting the surface temperatures of the central part 54 and end part 56 of the heat roller 40. Strictly, the temperatures detected by the temperature sensors 58A and 58B are the surface temperature of the belt 46, though in this embodiment, it is used as a surface temperature of the heat roller 40.

A control unit 60 includes a CPU and a memory and synthetically controls the image reading unit 2, image forming unit 3, and operation panel 5 and the fixing device 34 controls to drive a motor M for rotating the heat roller 40 and the exciting coil 50 for exciting the heat roller 40. The control unit 60 furthermore performs the image process of correcting, compressing, and extending image data, stores compressed image data and print data, and executes data communication with a PC (personal computer) 100 installed outside the image forming apparatus 1.

The induction heating member 48 gives uniformly the magnetic flux to the heat roller 40 so that the surface temperature of the heat roller 40 reaches 180% which is a fixing temperature. When a large size sheet such as an A3 size moves in the length direction of the sheet in the above state and passes through the nip portion, heat is lost to the large size sheet through the width of the heat roller 40. Therefore, the control unit 60 controls the input power so as to keep the surface temperature of the heat roller 40 at the fixing temperature 180° C. For example, the existing fixed temperature holding control such as at the stage that the surface temperature is lowered or the continuous passing of sheets is started, the control of slightly increasing the power or the control of increasing the input power and shortening the power supply time to the induction heating member 48 if the surface temperature rises or prolonging it if the surface temperature lowers can be used.

On the other hand, when a small size sheet moves in the length direction of the sheet and passes the nip portion at the central part 54, the heat in the neighborhood of the central part 54 of the heat roller 40 is lost to the small size sheet. Here, if the heat roller 40 is excited to keep the temperature of the central part 54 of the heat roller 40 at the fixing temperature 180° C., the end part 56 generates heat, though at the end part 56 where the small size sheet does not pass, no heat is lost to the sheet, so that the temperature at the end part 56 rises as compared with the temperature at the central part 54.

Further, the heat roller 40 is made of the degaussing alloy material 40*a*, so that if the exciting coil is driven at a fixed frequency and for example, as mentioned above, small size sheets pass continuously, the temperature at the end part 56 rises and approaches the Curie temperature, and the permeability μ lowers suddenly, and the magnetic flux by the exciting coil 50 does not stay in and permeates through the degaussing alloy material 40*a*. Therefore, the end part 56 is prevented from heat generation and the hot offset is suppressed. The hot offset is referred to as a phenomenon that the temperature is extremely high, thus toner is adhered to the roller.

However, if the permeability μ of the end part 56 is lowered and the magnetic flux by the exciting coil 50 does not stay in and permeates through the degaussing alloy material 40*a*, the epidermal resistance of the end part 56 of the heat roller 40 begins to reduce suddenly. Here, assuming the epidermal resistance of the entire degaussing alloy material 40*a* of the heat roller 40 as Rsa, the epidermal resistance of the central part 54 as Rsc, and the epidermal resistance of the end part 56 as Rse, the epidermal resistance Rsa is reduced in correspondence with the reduction in the epidermal resistance Rse, so that the impedance of the current supply circuit is reduced. Namely, the current flowing through the current supply circuit is increased. Furthermore, if the temperature of the heat roller 40 exceeds the Curies temperature and the impedance of the current supply circuit is reduced continuously, there is a fear that the current flowing through the circuit may exceed the allowable value. If the current flowing through the circuit exceeds the allowable value, the components composing the circuit may fail. Therefore, generally, control of reducing the power to be given to the heat roller 40 or turning off the drive for the circuit and stopping the supply of power to the heat roller 40 is executed. However, such control weakens or stops the heat generation of the central part 54 of the heat roller 40, thus there is a fear that the temperature of the nip portion may be lowered, causing defective fixing, so that the fixing cannot be continued. Further, it takes a lot of time to return again the temperature of the heat roller 40 to the fixing temperature.

Therefore, instead of the control of stopping to drive the current supply circuit, the driving of the exciting coil at the fixed frequency (the first drive frequency) is switched to driving at a higher frequency (the second drive frequency).

For example, a case that the exciting coil 50 is driven at the first drive frequency, that is, a fixed frequency of about 25 kHz and is given power of about 1100 W, and the heat roller 40 is excited at the fixing temperature 180° C., and A4-R size sheets are permitted to pass continuously is considered. In the state that the temperature at the end part 56 rises and exceeds the Curie temperature Tc, the permeability μ is lowered suddenly and the magnetic flux by the exciting coil 50 does not stay in and permeates through the degaussing alloy material 40*a* of the heat roller 40. At this time, the epidermal resistance Rse at the end part 56 is very low compared with the epidermal resistance Rsc at the central part 54 and can be ignored almost, so that the epidermal resistance Rsa of the entire degaussing alloy material 40*a* of the heat roller 40 becomes a load at the central part 54 maintained at the fixing temperature. Therefore, for example, when the length of the heat roller 40 in the longitudinal direction is 300 mm and the range of the short side 210 mm of an A4-R size sheet touches the central part 54, the epidermal resistance Rsa of the entire degaussing alloy material 40*a* of the heat roller 40 is about ⅔ times of the epidermal resistance Rsa in the stationary state and the impedance of the current supply circuit is reduced.

If the current supply circuit is driven in this state, the current flowing through the circuit is increased in correspondence with a reduction in the impedance. Therefore, in the present invention, so as to reduce the current to less than the allowable current, the exciting coil is driven at the second drive frequency which is higher, thus the epidermal resistance Rsa of the heat roller 40 is increased, and the impedance of the circuit is increased.

In Table 1, as an example, the calculation results of the epidermal depth when the frequency is switched from 25 kHz to 50 kHz on the basis of Formulas 2 and 5 are given. Further, for the physical values of resistivity and relative permeability of the degaussing alloy material 40*a*, general values are used and the concerned relative permeability is a ratio $\mu/\mu_0$ of the permeability 11 of the degaussing alloy material 40*a* to the permeability $\mu_0$ in a vacuum. Further, FIGS. 7A, 7B, 7C, and 7D respectively correspond to the rows I, II, III, and IV of Table 1.

TABLE 1

| | I | II | III | IV |
|---|---|---|---|---|
| Resistivity (Ω-mm) | 1.50E−04 | 1.50E−04 | 1.50E−04 | 1.50E−04 |
| Temperature (° C.) | 180 | 220 | 220 | 180 |
| Relative permeability | 100 | 1 | 1 | 100 |
| Frequency (Hz) | 25,000 | 25,000 | 50,000 | 50,000 |
| Epidermal depth (mm) | 0.12 | 1.23 | 0.87 | 0.09 |

Figure 7A:
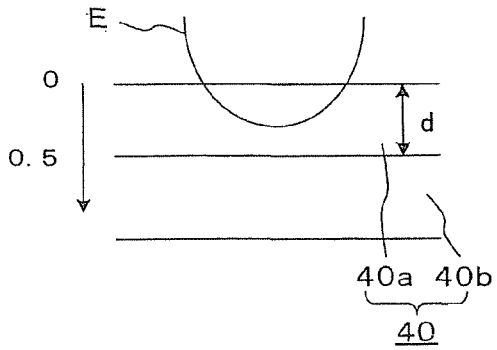
FIGS. 7A to 7D are drawings for explaining the relationship between the drive frequency and the epidermal depth.

Firstly, as shown in the row I in Table 1, when the exciting coil 50 is driven at a frequency of 25 kHz (the first drive frequency) and the temperature of the heat roller 40 is the fixing temperature 180° C., the epidermal depth δ is about 0.12 mm. Therefore, for example, when the thickness d of the degaussing alloy material 40*a* is 0.5 mm, as shown in FIG. 7A, magnetic flux E generated by the exciting coil 50 does not reach the conductive material 40*b* and passes through the degaussing alloy material 40*a* and by the eddy current Ie generated, the degaussing alloy material 40*a* generates heat. This is the general fixable state.

Figure 7B:
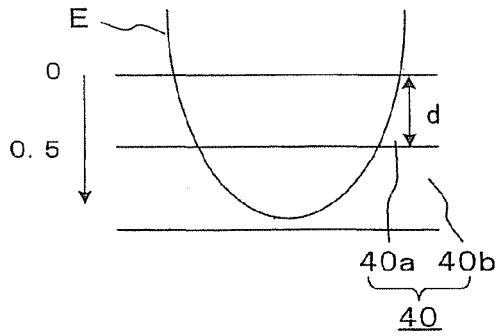

Further, as shown in the row II in Table 1, if small size sheets pass continuously when the exciting coil 50 is driven at a frequency of 25 kHz and the temperature of the end part 56 rises and reaches the Curie temperature 220° C., the epidermal depth δ is about 1.2 mm. Therefore, the magnetic flux E generated by the exciting coil 50, as shown in FIG. 7B, diverges up to the conductive material 40*b* across the degaussing alloy material 40*a* with a thickness of 0.5 mm, so that the eddy current Ie does not flow through the degaussing alloy material 40*a* and the heat generation of the degaussing alloy material 40*a* is suppressed. This state is a state that there is a fear that a current exceeding the allowable current may flow in the current supply circuit.

Figure 7C:
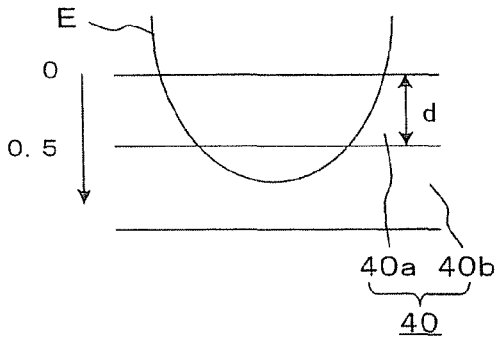

Here, if the exciting coil 50 is driven at a higher frequency of 50 kHz (the second drive frequency) switched from 25 kHz, the epidermal depth δ at the end part 56 the temperature of which is the Curie temperature 220° C., as shown in the row III in Table 1, is about 0.87 mm. Namely, at the end part 56 at the Curie temperature 220° C., even if driven at 50 kHz, as shown in FIG. 7C, the generated magnetic flux E diverges up to the conductive material 40*b*, so that the eddy current Ie does not flow in the degaussing alloy material 40*a*, thus the heat generation of the degaussing alloy material 40*a* is suppressed.

Figure 7D:
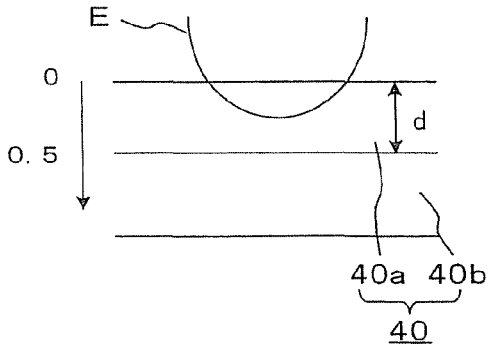

On the other hand, the epidermal depth 6 at the central part 54 when the temperature is the fixing temperature 180° C., as shown in the row IV in Table 1, is about 0.09 mm, so that as shown in FIG. 7D, the generated magnetic flux E does not reach the conductive material 40*b* and passes through the degaussing alloy material 40*a*. Therefore, by driving at a higher frequency, the epidermal resistance Rsc of the central part 54 is increased, thus the epidermal resistance Rsa of the entire heat roller 40 is increased, so that the impedance of the current supply circuit is increased, and the current amount flowing in the circuit can be suppressed. Further, the epidermal resistance Rsc of the central part 54 is increased, so that the heat release value at the central part 54 can be maintained, thus the fixing operation can be continued.

Furthermore, the statuses shown in FIGS. 7A to 7D will be explained using Formulas 6 to 9. Formulas 6 to 9 express the relationship between the thickness d [m] of the degaussing alloy material 40*a* of the heat roller 40 and the epidermal depth 6. Firstly, when driving the exciting coil at the first drive frequency $f_1$, the status that the thickness d [m] and the epidermal depth 6 are equal to each other is expressed by the following formula.

[Formula 6]

$$d = \delta = \sqrt{\frac{2\rho}{\omega_1 \mu_{(T_{TH})}}} = 503\sqrt{\frac{\rho}{\mu_{r(T_{TH})} f_1}} \qquad \text{Formula 6}$$

Namely, when the exciting coil is driven at the first drive frequency $f_1$, a lower temperature than the temperature $T_{TH}$ conforming to Formula 6 can be defined as a first temperature T1 and a higher temperature than the temperature $T_{TH}$ can be defined as a second temperature T2. Here, the temperature $T_{TH}$ is assumed as a temperature higher than the fixing temperature. Further, the temperature $T_{TH}$ conforming to Formula 6 is not limited to the Curie temperature.

Therefore, the status shown in FIG. 7 that the temperature of the heat roller 40 is the first temperature T1 lower than $T_{TH}$ is expressed by Formula 7A and the status shown in FIG. 7B that the temperature of the heat roller 40 is the second temperature T2 higher than $T_{TH}$ is expressed by Formula 8.

[Formula 7]

$$d > \delta = \sqrt{\frac{2\rho}{\omega_1 \mu_{(T1)}}} = 503\sqrt{\frac{\rho}{\mu_{r(T1)} f_1}} \qquad \text{Formula 7}$$

[Formula 8]

$$d < \delta = \sqrt{\frac{2\rho}{\omega_1 \mu_{(T2)}}} = 503\sqrt{\frac{\rho}{\mu_{r(T2)} f_1}} \qquad \text{Formula 8}$$

Here, when the heat roller 40, since the permeability is reduced, is put into the status expressed by Formula 8, it drives the circuit at the second drive frequency $f_2$ which is a higher frequency than the first drive frequency $f_1$, thus the range that the temperature of the heat roller 40 is the second temperature T2 is put into the status shown in FIG. 7C and the range that the temperature of the heat roller 40 is the first temperature T1 is put into the status shown in FIG. 7D. Therefore, the second drive frequency $f_2$ is assumed to conform to Formula 9.

[Formula 9]

$$d < \delta = \sqrt{\frac{2\rho}{\omega_2 \mu_{(T2)}}} = 503\sqrt{\frac{\rho}{\mu_{r(T2)} f_2}} \qquad \text{Formula 9}$$

Namely, the second drive frequency $f_2$ is assumed as a frequency when the temperature of the heat roller 40 becomes the second temperature T2 and the reduction range of the permeability μ, for example, the epidermal depth δ at the end part 56 is larger than the thickness d of the degaussing alloy material 40*a* of the heat roller 40. In the actual control, it is desirable to experiment beforehand on the second drive frequency for each sheet size and acquire data conforming to Formula 9, or calculate from a theoretical formula conforming to Formula 9, or store beforehand the program for calculation in the memory of the control unit 60 and execute control on the basis of it by the control unit 60.

Further, it is desirable to switch ideally the second drive frequency to a drive frequency only for increasing the reduced amount of the epidermal resistance Rs of the heat roller 40, though it is desirable to permit at least the current after switching to be less than the allowable current. Further, conversely speaking, the thickness d of the degaussing alloy material 40*a* of the heat roller 40, for the permeability μ and frequency f which are changed, becomes the thickness conforming to Formulas 6 to 9. Further, the range that the temperature of the heat roller 40 is the first temperature T1, for example, at the central part 54, when driven at the second drive frequency, naturally, the epidermal depth δ becomes smaller than the thickness d of the degaussing alloy material 40*a*.

Further, when continuing the fixing operation by driving the current supply circuit at the second drive frequency, the temperature of the end part 56 which is suppressed from heat generation lowers slowly. Therefore, if the temperature of the heat roller 40 becomes lower than the temperature $T_{TH}$ conforming to Formula 6, the epidermal depth 6 at the end part 56 becomes smaller than the thickness d of the degaussing alloy material 40*a* of the heat roller 40. Here, strictly speaking, the degaussing alloy material 40*a* draws a hysteresis loop, so that the temperature $T_{TH}$ conforming to Formula 6, when the temperature of the heat roller 40 rises or lowers, may be lowered when it lowers. Therefore, when the temperature of the heat roller 40 excited at the second drive frequency $f_2$ lowers from the second temperature T2 to the first temperature T1, the status that the thickness d of the degaussing alloy material 40*a* and the epidermal depth δ are equal to each other is expressed by the following formula.

[Formula 10]

$$d = \delta = \sqrt{\frac{2\rho}{\omega_2 \mu_{(T'_{TH})}}} = 503\sqrt{\frac{\rho}{\mu_{r(T'_{TH})} f_2}} \qquad \text{Formula 10}$$

where $T_{TH}' \leqq T_{TH}$.

Therefore, when the temperature of the end part 56 of the heat roller 40 becomes lower than the temperature $T_{TH}'$ conforming to Formula 10 and returns to the status shown in FIG. 7A, this time, the impedance of the current supply circuit is extremely high and the current flowing in the circuit is suppressed excessively, so that the heat roller 40 is driven at the third drive frequency lower than the second drive frequency, for example, 50 kHz and the heat release value of the heat roller 40 is ensured.

In the fixing device 34 aforementioned, the temperature of the degaussing alloy material 40*a*, for example, of the end part 56 becomes a temperature higher than the temperature $T_{TH}$ conforming to Formula 6, and the epidermal depth δ becomes larger than the thickness of the degaussing alloy material 40*a*, and even if an excessive current flows into the current supply circuit driven at the first drive frequency, it conforms to Formula 9, and the current supply circuit is driven at the second drive frequency which is higher than the first drive frequency, thus the current flowing in the current supply circuit is reduced, does not exceed the allowable current, and can be used within a normal current range. Therefore, the power is supplied stably without interrupting the power supply of the current supply circuit, thus the fixing can be continued. Further, in FIG. 6, the sheet passing through the nip portion of the heat roller 40 is based on the center of the sheet in the width direction and in the degaussing alloy material 40*a*, the temperatures of both end parts 56 rise, though the present invention is not limited to it. For example, one side approaching one end of the heat roller 40 may be used as a reference. In this case, when a small size sheet passes, the temperature at the end part on the opposite side to the side where the sheet approaches rises.

(An Example of the Current Supply Circuit)

Figure 8:
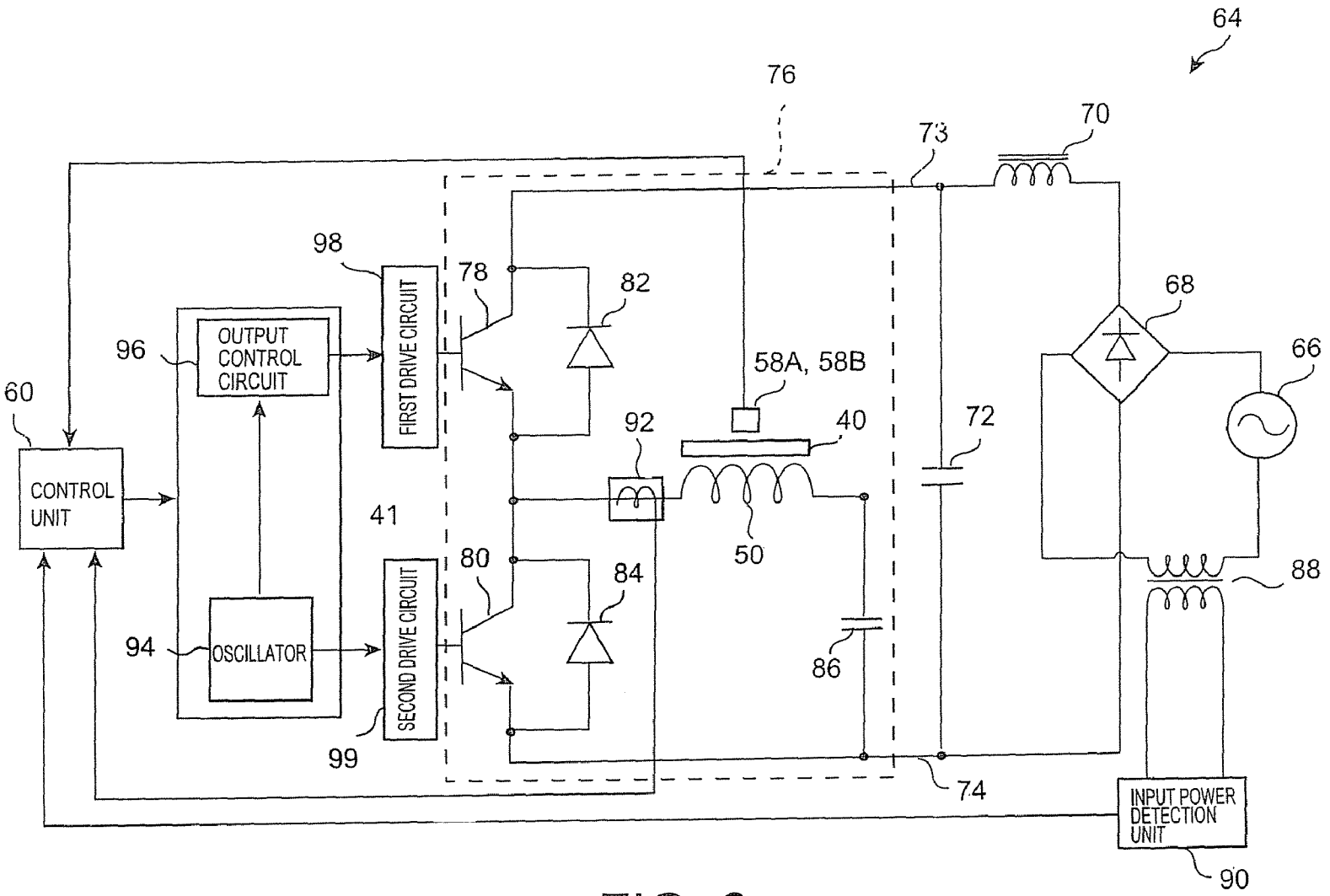
FIG. 8 is a current supply circuit showing an example of the electrical schematic constitution.

Then, an example of the current supply circuit will be explained. FIG. 8 is an electrical schematic diagram of the current supply circuit. A current supply circuit 64 includes an AC source 66, a rectification circuit 68 for rectifying the AC power, and an inverter circuit 76.

The rectification circuit 68 is of a diode bridge type and to the AC input terminal, the AC source 66 is connected. To the positive pole of the AC output terminal, a choke coil 70 is connected in series and between the other end of the choke coil 70 and the negative pole of the DC output terminal of the rectification circuit 68, a smoothing condenser 72 is connected. Further, both ends of the smoothing condenser 72 and the inverter circuit 76 are connected to each other via DC bus lines 73 and 74.

The inverter circuit 76 includes first and second switching elements 78 and 80 of the two IGBTs (insulated gate bipolar transistors) and the first and second switching elements are connected in series between the DC bus lines 73 and 74. Between the collector emitters of the first and second switching elements 78 and 80, first and second diodes 82 and 84 are connected in parallel. Further, at the middle point of connection of the first switching element 78 and the second switching element 80, the exciting coil 50 and a resonant capacitor 86 are connected in series, and the other end of the resonant capacitor 86 is connected to the DC bus line 74.

Between the AC input side of the rectification circuit 68 and the AC source 66, a transistor 88 is arranged and an input power detection unit 90 connected to the transistor 88 detects input power. The input power detection unit 90 is connected to the control unit 60 including a CPU and a memory and transmits the information of the detected input power to the control unit 60. Further, between the middle point of connection of the first switching element 78 and the second switching element 80 and the exciting coil 50, a current detection unit 92 for detecting the current flowing in the inverter circuit 75 is installed and the current detection unit 92 transmits a signal of the detected current to the control unit 60. The control unit 60 receives a signal from the input power detection unit 90, current detection unit 92, or a temperature sensor 58A or 58B, thus the feedback control of the power to be given to the exciting coil 50 can be executed. Further, the control unit 60 controls an oscillator 94 and an output control circuit 96.

The oscillator 94 oscillates at a fixed and predetermined frequency and outputs the oscillation output signal to an output control circuit 96 for controlling a first drive circuit 98 and a second drive circuit 99. Here, the output control circuit 96 changes the output pulse width to be outputted to the first drive circuit 98 under the control of the control unit 60, changes the on and off time of the first switching element 78 via the first drive circuit 98, and controls the circuit output within the range from 0 to 100%. On the other hand, the second drive circuit 99 receives the oscillation output directly from the oscillator 94 and turns on or off the second switching element 80. By the on and off operation, a high-frequency current flows through the exciting coil 50 and a predetermined magnetic field is generated.

Figures 9A, 9B, 9C, 9D, 9E:
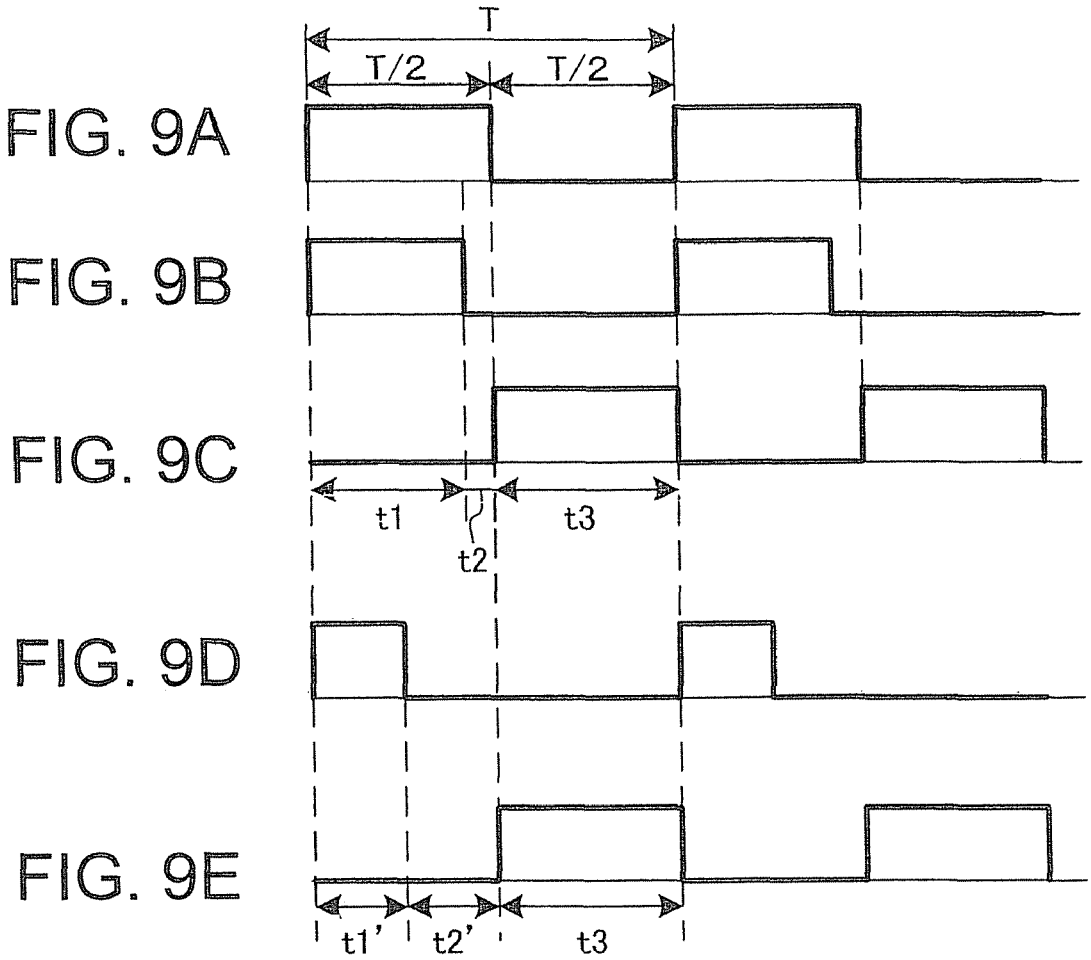
FIGS. 9A to 9E are time charts showing the operation of the current supply circuit shown in FIG. 8.

As shown in FIGS. 9A to 9E, for example, the oscillator 94, during a period T equivalent to a frequency of about 25 kHz, outputs a pulse with a T/2 width to the output control circuit 96 and second drive circuit 99 (FIG. 9A). Here, when driving at large power such as at the time of warm-up, or at the time of return from the sleep mode, or at the time of the operation of permitting sheets to pass the nip portion and fixing toner, the output control circuit 96 outputs a pulse with a t1 time width slightly shorter than that of the pulse with a T/2 width to the first drive circuit 98 (FIG. 9B). On the other hand, the second drive circuit 99 receives the pulse with a T/2 width directly from the oscillator 94 (FIG. 9C). Therefore, the first and second drive circuits 98 and 99 output respectively on-signals with a time width corresponding to the respective input pulses to the first and second switching elements 78 and 80. Further, when driving at a small power such as at the standby time, the output control circuit 96 outputs a pulse with a t1' time width shorter than the t1 time width to the first drive circuit 98 (FIG. 9D). On the other hand, the pulse received by the second drive circuit 99 from the oscillator 94 is unchangeably a one with the T/2 width (FIG. 9E).

As mentioned above, the current supply circuit 64 of this embodiment does not execute the output control by changing the frequency but fixing the drive frequency of the inverter circuit 76, controlling the on-time only of the first switching element 78 long or short, thereby executing the output control of the exciting coil 50. Further, as a current supply circuit for fixing the drive frequency and executing the output control of the coil, additionally, the inverter circuit described in Japanese Patent Application Publication No. 10-92564 such as the control of shortening the power supply time of the first switching element 78 and prolonging the power supply time of the second switching element 80 and also other well-known arts can be used.

Embodiment 1 of Heating Control

Figure 10A:
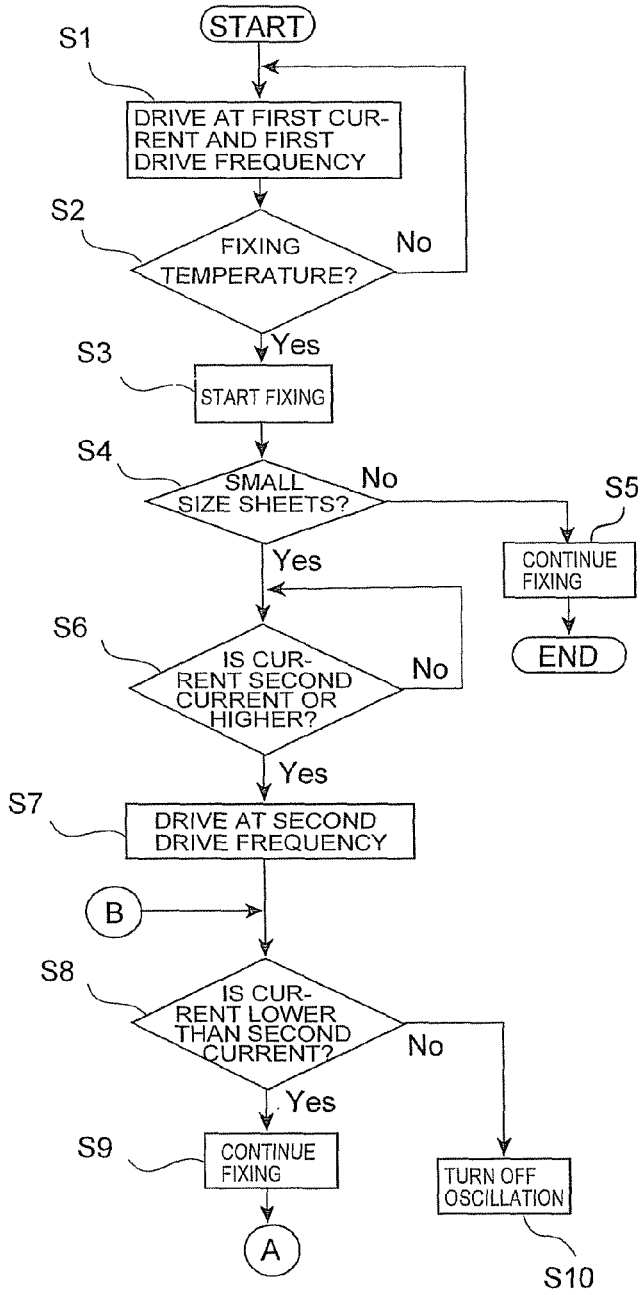
FIG. 10A is a flow chart showing an example of control when the permeability of the heat roller lowers as Embodiment 1 of heating control.
Figure 10B:
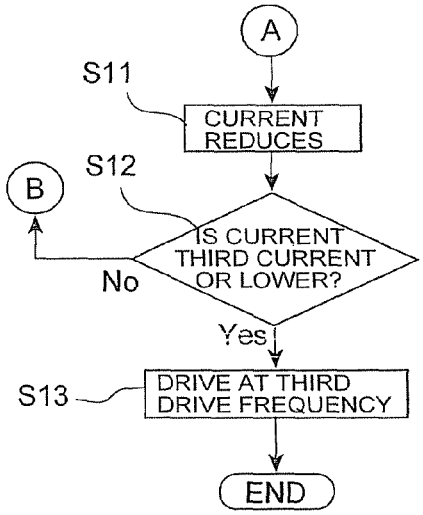
FIG. 10B is a flow chart showing an example of control when the lowered permeability is recovered.

FIGS. 10A and 10B are flow charts showing an example of the temperature control of the heat roller. FIG. 10A is an example of control when the permeability of the heat roller lowers. Further, FIG. 10B is an example of control when the lowered permeability is recovered. Further, the maximum value of the current flowing in the exciting coil 50 when the temperature of the heat controller 40 does not exceed the Curie temperature and the permeability of the heat roller 40 is sufficiently high is assumed as about 60 A and the allowable current of the inverter circuit 76 is assumed as about 80 A.

Firstly, at the startup time of raising the surface temperature of the heat roller 40 up to the fixing temperature such as at the warm-up time or at the return time from the sleep mode, the control unit 60 controls the oscillator 94 and output control circuit 96 and permits the oscillator 94 to output a frequency of 20 to 30 kHz, for example, the first drive frequency of about 25 kHz to the output control circuit 96 and second drive circuit 99 and gives power of about 1,100 W to the exciting coil 50 (Step S1). At this time, the current flowing in the circuit is the first current (for example, 60 A or lower).

Further, the temperature sensors 58A and 58B monitor the surface temperature of the heat roller 40 and when they detect that the temperature of the heat roller 40 reaches the fixing temperature 180° C. (Step S2), the image forming unit 3 controlled by the control unit 60 starts image formation and the fixing device 34 performs the fixing operation (Step S3). When the sheet size passing the nip portion of the heat roller 40 is the A3 size (Step S4), the heat roller 40 is maintained at the fixing temperature 180° C. free of an occurrence of a local temperature rise and the fixing operation is continued (Step S5).

On the other hand, when small size sheets such as A4-R size pass continuously through the nip portion of the heat roller 40 (Step S4), the control unit 60, on the basis of a signal from the temperature sensor 58A, maintains the temperature of the central part 54 of the heat roller 40 at the fixing temperature 180%. At the end part 56 where the small size sheets do not pass, no heat is lost to the sheets, so that the temperature of the end part 56 rises.

If the temperature of the end part 56 rises and approaches the Curie temperature, and the permeability of the end part 56 of the heat roller 40 is lowered, thus the magnetic flux by the exciting coil 50 does not stay in and permeates through the degaussing alloy material 40*a*, the epidermal resistance Rsa of the entire heat roller 40 is reduced, and the impedance of the inverter circuit 76 is reduced. Therefore, the current flowing through the exciting coil 50 and inverter circuit 76 is increased.

The current detection unit 92 detects the current flowing in the inverter circuit 76. When the current detection unit 92 detects that the concerned current is the second current, which is set lower than the allowable current 80A of the inverter circuit 76, for example, 70 A or higher (Step S6), the control unit 60 changes the drive frequency to the higher second drive frequency of 40 to 60 kHz, for example, 50 kHz and drives the inverter circuit 76 (Step S7). If the inverter circuit 76 is driven at the second drive frequency, as mentioned above, the eddy current Ie flowing through the central part 54 of the heat roller 40 is concentrated in and flows through the shallow area of the surface of the central part 54 by the epidermal effect of the magnetic flux, and the epidermal resistance Rsc of the central part 54 is increased, and the epidermal resistance Rsa of the entire heat roller 40 is increased apparently. Therefore, when the current flows excessively in the inverter circuit 76, the drive frequency is increased, thus the current flowing in the inverter circuit 76 is reduced, and the inverter circuit 76 can be driven within the normal current range, and the central part 54 of the heat roller 40 is heated, and the fixing can be continued. However, the second drive frequency $f_2$ is assumed to conform to Formula 9.

At Step S8, when the current flowing in the inverter circuit 76 which is detected by the current detection unit 92 is reduced to lower than the second current 70 A, the fixing operation is continued (Step S9).

On the other hand, at Step S8, although the inverter circuit 76 is driven at the second drive frequency 50 kHz, if the current flowing in the inverter circuit 76 is not reduced to lower than the second current 70 A, the control unit 60 judges that an error is caused in the circuit and turns off the drive of the first and second switching elements 78 and 80 (Step S10).

Then, if the fixing operation is continued at Step S9, the neighborhood of the central part 54 of the heat roller 40 generates heat due to the magnetic flux from the exciting coil 50 and the surface temperature is maintained at the fixing temperature. On the other hand, the end part 56 of the heat roller 40 lowers slowly in the surface temperature.

If the temperature of the heat roller 40 becomes lower than the temperature $T_{TH}$ conforming to Formula 6, the epidermal depth δ becomes smaller than the thickness d of the degaussing alloy material 40*a* of the heat roller 40. Namely, the impedance of the circuit is increased and the current flowing in the inverter circuit 76 is reduced (Step S11). Therefore, if the current flowing in the exciting coil 50, which is detected by the current detection unit 92, becomes the third current necessary to supply power necessary to continue the fixing operation to the exciting coil 50 or lower (Step S12), the control unit 60 changes the drive frequency to the third drive frequency which is lower than the second drive frequency 50 kHz and ensures the heat release value of the heat roller 40. Here, the third drive frequency, for example, is changed to the first drive frequency 25 kHz and the inverter circuit 76 is driven (Step S13). Further, instead of changing the third drive frequency large from 50 kHz to 25 kHz, for example, it may be reduced stepwise such as every 5 kHz or may be reduced slowly.

According to the fixing device 34 of Embodiment 1 aforementioned, the degaussing alloy material 40*a* is used for the heat roller 40, so that even if sheets with a narrow width pass continuously, the portion where no sheets pass will not become abnormally high in temperature and even if sheets with a wide width pass thereafter, no hot offset is caused.

Further, even if the temperature of the portion of the heat roller 40 where no sheets pass rises higher than the temperature $T_{TH}$ conforming to Formula 6, and the epidermal depth δ becomes larger than the thickness d of the degaussing alloy material 40*a*, and an excessive current flows in the inverter circuit 76 driven at the first drive frequency, when driving the inverter circuit 76 at the second drive frequency which conforms to Formula 9 and is higher than the first drive frequency, the current flowing in the inverter circuit 76 is reduced, does not exceed the allowable current, and can be used within the normal current range. Therefore, without interrupting the power supply to the inverter circuit 76, the power is supplied stably and the fixing can be continued.

Further, the aforementioned control is executed by the inverter circuit 76 for executing output control by changing the power supply time of the switching element instead of changing the frequency, so that there is no need to install separately a particular member, thus the apparatus will not be made larger. Further, no unnecessary member is installed, so that the degree of freedom of the design of arrangement of the exciting coil 50 will not be lowered.

Further, even if no division coil is used, control for suppressing temperature irregularities of the heat roller 40 in the axial direction can be executed, so that the number of inverter circuits 76 can be reduced and the cost can be suppressed. Further, a division coil may be used.

Further, the first to third currents and the first to third drive frequencies may be stored beforehand in the memory by experimentation or calculation or the program for calculation is stored beforehand in the memory of the control unit 60 and on the basis of it, the control unit 60 may control them.

Embodiment 2 of Heating Control

Figure 11A:
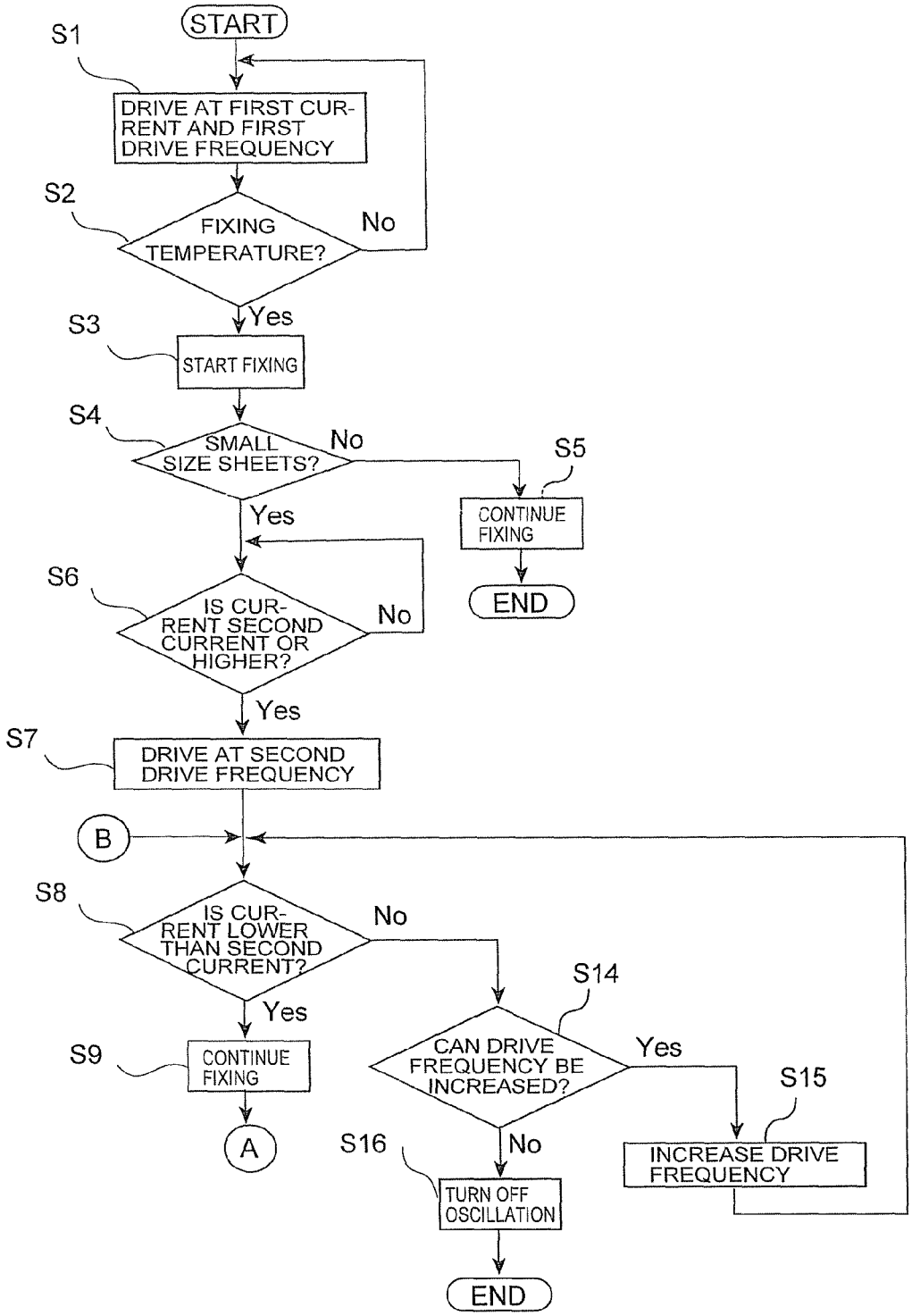
FIG. 11A is a flow chart showing another example of temperature control of the heat roller as Embodiment 2 of heating control.

FIG. 11 is a flow chart showing another example of temperature control of the heat roller. Hereinafter, to the same components as those shown in FIGS. 10A and 10B, the same numerals are assigned and only the characteristic portions of this embodiment will be explained.

In FIG. 11, the difference from FIGS. 10A and 10B is the NO of Step S8 and subsequent control. In this embodiment, at Step S8, for example, although the inverter circuit 76 is driven at the second drive frequency 50 kHz, if the current flowing in the inverter circuit 76 is not reduced to lower than the second current 70 A, the control unit 60 judges whether the frequency can be increased furthermore or not (Step S14).

The drive frequency after increase which is higher than the second drive frequency is assumed as fx and if fx conforms to the next Formula 11, it may be said that the frequency can be increased furthermore.

[Formula 11]

$$d < \delta = \sqrt{\frac{2\rho}{\omega_x \mu_{(T2)}}} = 503\sqrt{\frac{\rho}{\mu_{r(T2)} f_x}} \qquad \text{Formula 11}$$

When fx conforms to Formula 11, the current drive frequency is increased by a predetermined frequency (for example, 5 kHz). The process returns again to Step S8 and the aforementioned steps are repeated. At Step S14, when the control unit 60 judges that the drive frequency fx after increase does not conform to Formula 11, considering that an error is caused in the circuit, the control unit 60 turns off the drive of the first and second switching elements 78 and 80 (Step S16). Further, the control unit 60, as a permeability corresponding to the second temperature T2, may judge by using the permeability corresponding to a preset target temperature or may judge by detecting the current temperature and judging from Formula 11 using the permeability corresponding to it. Or, the control unit 60 may obtain beforehand the maximum value of the drive frequency fx conforming to Formula 11 from experimentation or theoretical calculation and store it in the memory and on the basis thereof, control so that the drive frequency fx after increase becomes the maximum value or smaller.

According to the fixing device 34 of Embodiment 2 aforementioned, the similar effect to that of the fixing device of Embodiment 1 of heating control can be obtained and additionally, the control unit 60 does not turn off suddenly the switching elements and can judge an error in the circuit at the latter stage. Therefore, the fixing operation is not stopped frequently, so that the usability of a user is satisfactory.

Embodiment 3 of Heating Control

Figure 12A:
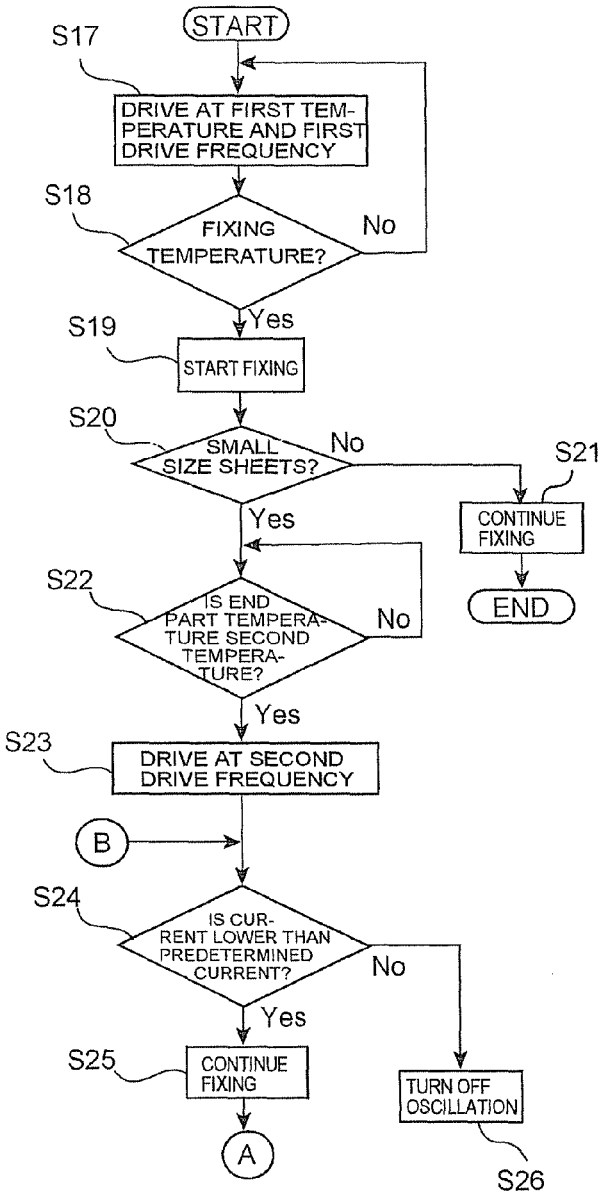
FIGS. 12A and 12B are flow charts showing still another example of temperature control of the heat roller as Embodiment 3 of heating control.
Figure 12B:
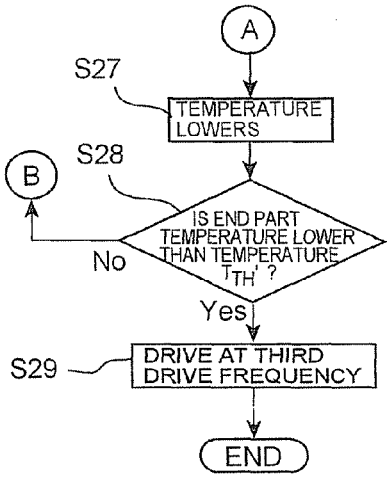

FIGS. 12A and 12B are flow charts showing still another example of temperature control of the heat roller. FIG. 12A shows an example of control when the permeability of the heat roller is lowered. Further, FIG. 12B shows an example when the reduced permeability is recovered. Hereinafter, to the same components as those shown in FIGS. 10A and 10B, the same numerals are assigned and only the characteristic portions of this embodiment will be explained.

In this embodiment, the control of changing the drive frequency of the inverter circuit 76 is not executed by detecting the current flowing in the exciting coil 50 but is executed by detecting the surface temperature of the heat roller 40.

Firstly, the control unit 60 controls the oscillator 94 and output control circuit 96 and permits the oscillator 94 to output the first drive frequency of 20 to 30 kHz, for example, a frequency of about 25 kHz to the output control circuit 96 and second drive circuit 99 and gives power of about 1100 W to the exciting coil 50 (Step S17). Further, similarly to the embodiment aforementioned, when driving the exciting coil at the first drive frequency $f_1$, a temperature which is higher than the fixing temperature and lower than the temperature $T_{TH}$ conforming to Formula 6 is defined as a first temperature T1 and a temperature higher than the temperature $T_{TH}$ is defined as a second temperature T2.

Further, when the temperature sensors 58A and 58B monitoring the surface temperature of the heat roller 40 detect that the temperature of the heat roller 40 reaches the fixing temperature 180° C. (Step S18), the image forming unit 3 controlled by the control unit 60 starts image formation and the fixing device 34 performs the fixing operation (Step S19). When the sheet size passing the nip portion of the heat roller 40 is the A3 size (Step S20), the heat roller 40 is maintained at the fixing temperature 180° C. free of an occurrence of a local temperature rise and the fixing operation is continued (Step S21).

On the other hand, when small size sheets such as A4-R size pass continuously through the nip portion of the heat roller 40 (Step S20), the control unit 60, on the basis of a signal from the temperature sensor 58A, maintains the temperature of the central part 54 of the heat roller 40 at the fixing temperature 180° C. At the end part 56 where the small size sheets do not pass, no heat is lost to the sheets, so that the temperature of the end part 56 rises.

If the temperature of the end part 56 rises, and the permeability of the end part 56 of the heat roller 40 is lowered, and the magnetic flux by the exciting coil 50 does not stay in and permeates through the degaussing alloy material 40*a*, the impedance of the inverter circuit 76 is reduced. Therefore, the current flowing through the exciting coil 50 and inverter circuit 76 is increased. The control unit 60, to prevent the current from exceeding the allowable current of the inverter circuit 76, controls as indicated below.

The control unit 60 judges whether the temperature of the end part 56 of the heat roller 40 which is detected by the temperature sensor 52B is the first temperature lower than the temperature $T_{TH}$ conforming to Formula 6 or the second temperature T2 higher than the temperature $T_{TH}$ (Step S22). When the temperature of the end part 56 is the second temperature, the control unit 60 changes the drive frequency to the higher second drive frequency of 40 to 60 kHz, for example, 50 kHz and drives the inverter circuit 76 (Step S23). Further, the temperature $T_{TH}$, by obtaining beforehand a temperature by experimentation or calculation and storing it in the memory or storing a calculation program in the memory, may be judged on the basis of it. Further, the second temperature may be a temperature when a predetermined current (the second current) which is the allowable current of the circuit or lower flows in the inverter circuit 76. As mentioned above, since the inverter circuit 76 is driven at the second drive frequency, it can be driven within the normal current range and the central part 54 of the heat roller 40 is heated, thus the fixing can be continued.

At Step S24, when the current flowing in the inverter circuit 76 which is detected by the current detection unit 92 is reduced to less than a predetermined current, the fixing operation is continued (Step S25).

On the other hand, at Step S24, although the inverter circuit 76 is driven at the second drive frequency 50 kHz, if the current flowing in the inverter circuit 76 is not reduced to lower than the predetermined current, the control unit 60 judges that an error is caused in the circuit and turns off the drive of the first and second switching elements 78 and 80 (Step S26).

If the fixing operation is continued at Step S25, the central part 54 generates heat due to the magnetic flux from the exciting coil 50 and the surface temperature is maintained at the fixing temperature. On the other hand, the end part 56 of the heat roller 40 lowers slowly in the surface temperature (Step S27). Namely, the impedance of the circuit is increased and the current flowing in the inverter circuit 76 is reduced slowly.

If the temperature of the end part 56 of the heat roller 40 which is detected by the temperature sensor 58B becomes lower than the temperature $T_{TH}'$ conforming to Formula 10 and the epidermal depth δ becomes smaller than the thickness d of the degaussing alloy material 40*a* of the heat roller 40, the control unit 60 drives the drive frequency at the third drive frequency which is lower than the second drive frequency 50 kHz, for example, 25 kHz and ensures the heat release value of the heat roller 40 (Step S29). Further, the third drive frequency is not changed at a time from 50 kHz to 25 kHz and, for example, it may be reduced stepwise such as every 5 kHz or may be reduced slowly.

According to the fixing device 34 of Embodiment 3 aforementioned, the similar effect to that of the fixing device of Embodiment 1 can be obtained.

Further, at Step S24. the control unit 60 judges whether or not to detect the current and continue the fixing, though the present invention is not limited to it. For example, instead of the current, the control unit 60 may detect the temperature of the end part 56 by the temperature sensor 58B and judge whether or not to continue the fixing. Namely, when the temperature of the end part 56 detected by the temperature sensor 58B is lower than a predetermined temperature, for example, the temperature when the drive frequency is switched to the second drive frequency, the fixing may be continued. Further, the predetermined temperature may be the temperature corresponding to the predetermined current flowing in the circuit, which may be obtained beforehand from experimentation or calculation and stored in the memory.

Embodiment 4 of Heating Control

Figure 13:
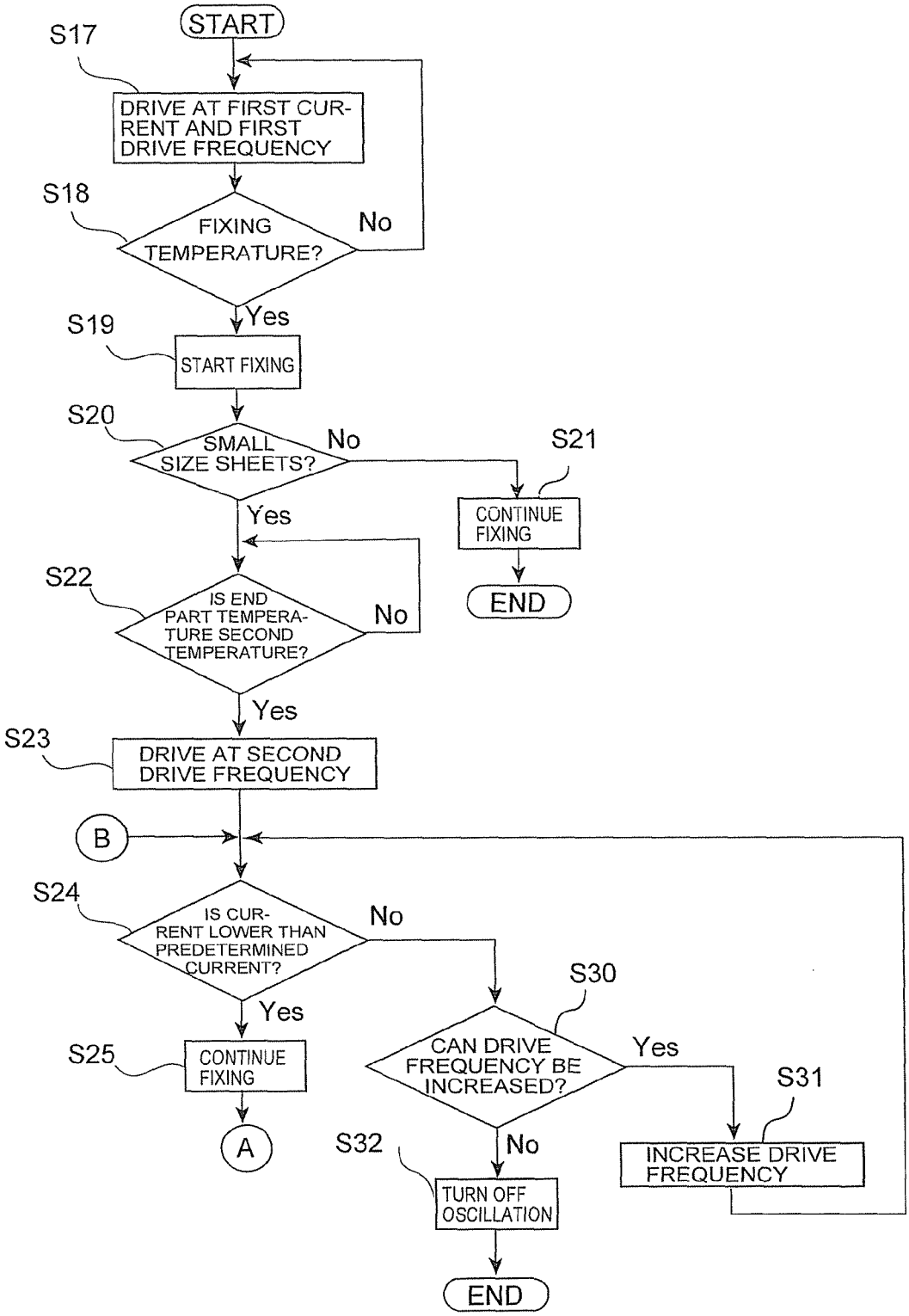
FIG. 13 is a flow chart showing a further example of temperature control of the heat roller as Embodiment 4 of heating control.

FIG. 13 is a flow chart showing a further example of temperature control of the heat roller. Hereinafter, to the same components as those shown in FIGS. 12A and 12B, the same numerals are assigned and only the characteristic portions of this embodiment will be explained.

Even in this embodiment, similarly to Embodiment 2, at Step S24 and the subsequent steps, Steps S30 to S32 as shown in FIG. 13 can be used.

Namely, at Step S24, for example, although the inverter circuit 76 is driven at the second drive frequency 50 kHz, if the current flowing in the inverter circuit 76 is not reduced to lower than the predetermined current 70 A, the control unit 60 judges whether the frequency can be increased furthermore or not (Step S30). The drive frequency after increase which is higher than the second drive frequency is assumed as fx and if fx conforms to Formula 11, it may be said that the frequency can be increased furthermore.

When fx conforms to Formula 11, the current drive frequency is increased by a predetermined frequency (for example, 5 kHz). The process returns again to Step S24 and the aforementioned steps are repeated. At Step S30, when the control unit 60 judges that the drive frequency fx after increase does not conform to Formula 11, considering that an error is caused in the circuit, the control unit 60 turns off the drive of the first and second switching elements 78 and 80 (Step S32). Therefore, the control unit 60 does not turn off suddenly the switching elements and can judge an error in the circuit at the latter stage, so that the fixing operation is not stopped frequently and the usability of a user is satisfactory.

Embodiment 5 of Heating Control

In this embodiment, the number of continuous passing sheets of a small size to be fixed is counted and when the number of counted sheets exceeds a fix value, the control unit 60 executes control of changing the drive frequency of the inverter circuit 76. Hereinafter, to the same components as those shown in the embodiment aforementioned, the same numerals are assigned and only the characteristic portions of this embodiment will be explained.

Figure 14:
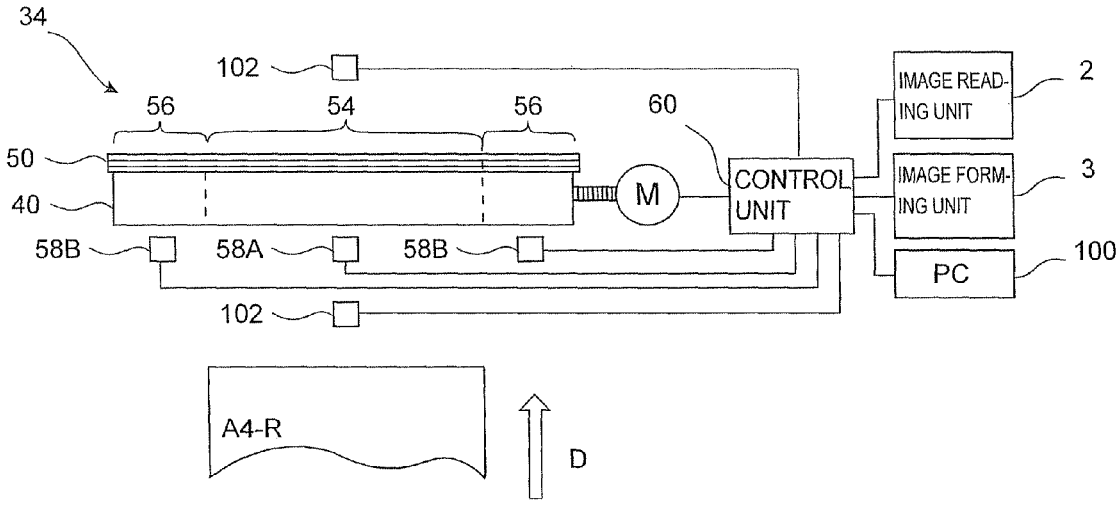
FIG. 14 is a schematic view for explaining a still further example of temperature control of the heat roller as Embodiment 5 of heating control.

As shown in FIG. 14, on the upstream side or the downstream side of the fixing device 34 in the conveying direction, a sheet detector 102 having a micro-sensor and a micro-actuator is arranged. The sheet detector 102 detects sheets conveyed. The control unit 60, when fixing small size sheets, counts the number of sheets detected by the sheet detector 102.

Figure 15:
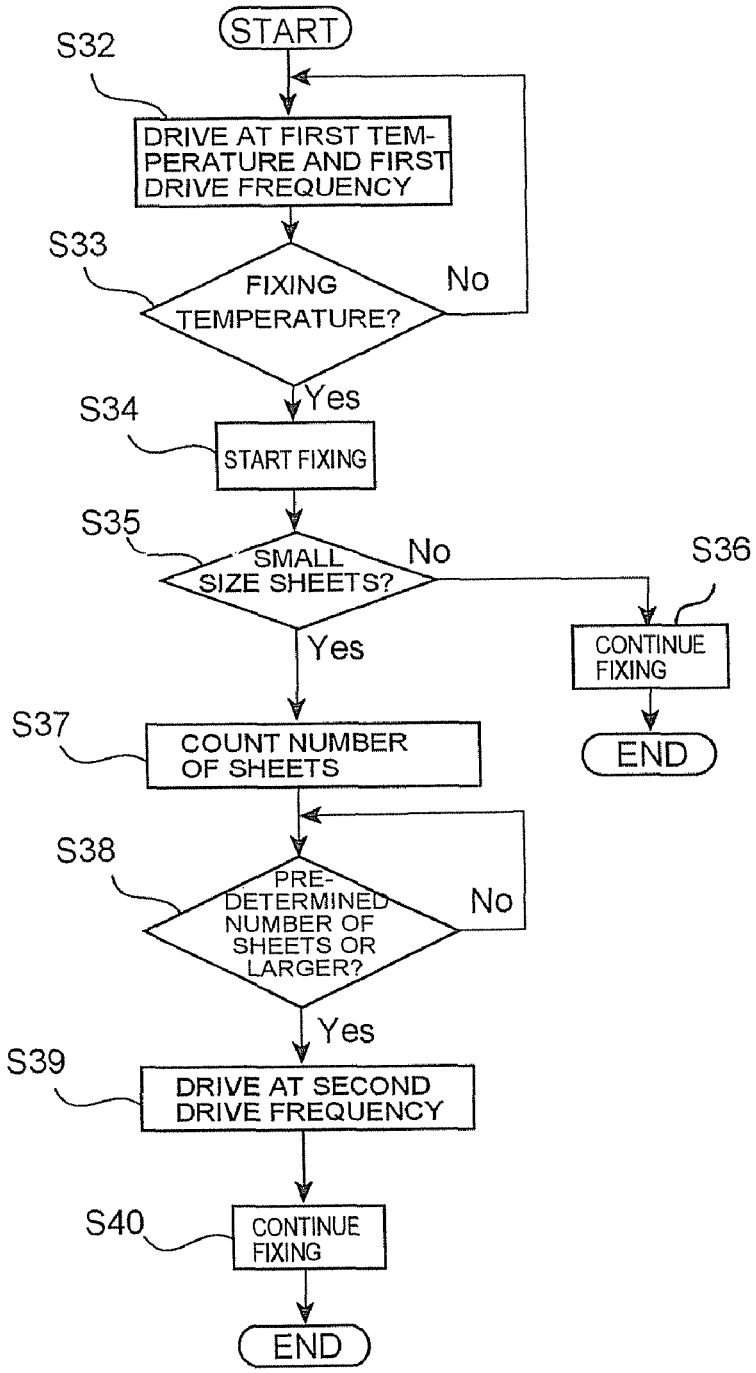
FIG. 15 is a flow chart showing yet a further example of temperature control of the heat roller as Embodiment 5 of heating control.

FIG. 15 is a flow chart showing an example of temperature control of the heat roller of this embodiment. Further, Steps S32 to S36 are similar to Steps S1 to S5 shown in FIG. 10A and Steps S17 to S21 shown in FIG. 12A, so that the explanation for them will be omitted.

When, for example, small size sheets such as A4-R size pass continuously through the nip portion of the heat roller 40 (Step S35), the control unit 60 starts to count the number of small size sheets to be conveyed (Step S37). Further, whether the sheet size to be conveyed is a small size or not, for example, is judged by the control unit 60 on the basis of an input instruction from the operation panel 5 or the PC 100. Further, the control unit 60, on the basis of a signal from the temperature sensor 58A, controls the input power so as to keep the surface temperature of the central part 54 of the heat roller 40 at the fixing temperature 180° C. At the end part 56 where the small size sheets do not pass through, no heat is lost to the sheets, so that the temperature of the end part 56 rises.

The control unit 60, at Step S38, judges whether the number of small size sheets counted exceeds a predetermined number or not and when it exceeds the number, changes the drive frequency to the higher second drive frequency 40 to 60 kHz, for example, 50 kHz, drives the inverter circuit 76 (Step S39), and continues the fixing operation (Step S40). Further, for the predetermined number for switching the drive frequency to the second drive frequency, the number of passing sheets when the temperature of the end part 56 becomes the second temperature which is higher than the temperature $T_{TH}$ conforming to Formula 6 may be obtained beforehand from experimentation or calculation and stored in the memory.

According to the fixing device 34 of Embodiment 5 aforementioned, when the small size sheets pass continuously, the inverter circuit 76 is driven at the second drive frequency higher than the first drive frequency, so that the current flowing in the inverter circuit 76 can be used within the normal current range. Therefore, the power is supplied stably without interrupting the power supply of the current supply circuit and the fixing can be continued.

Embodiment 6 of Heating Control

In this embodiment, the time from job start of small size sheets to be fixed is measured and when the continuous sheet passing time exceeds a fixed period of time, the control unit 60 executes control of changing the drive frequency of the inverter circuit 76. Hereinafter, to the same components as those shown in the embodiment aforementioned, the same numerals are assigned and only the characteristic portions of this embodiment will be explained.

Figure 16:
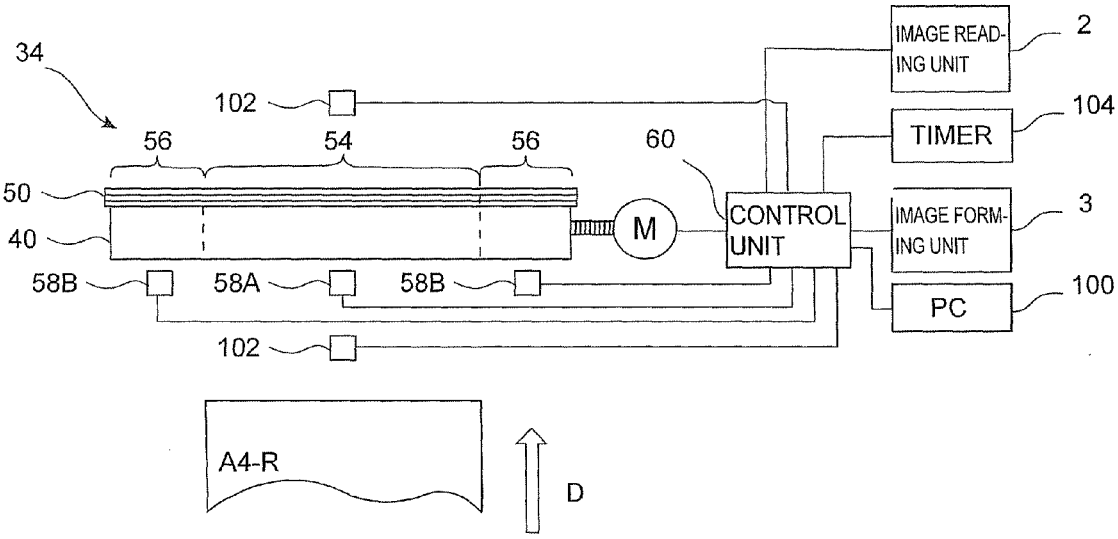
FIG. 16 is a schematic view for explaining yet a further example of temperature control of the heat roller as Embodiment 6 of heating control.

As shown in FIG. 16, a timer 104 which is a time measuring means for measuring the time from job start is connected to the control unit 60. The timer 104, by an instruction of the control unit 60, measures the time from start of image formation. Or, it may measure the time from detection of sheets by the sheet detector 102 arranged in the sheet conveying path inside the image forming unit 3. Further, the timer 104 may be possessed by the control unit 60.

Figure 17:
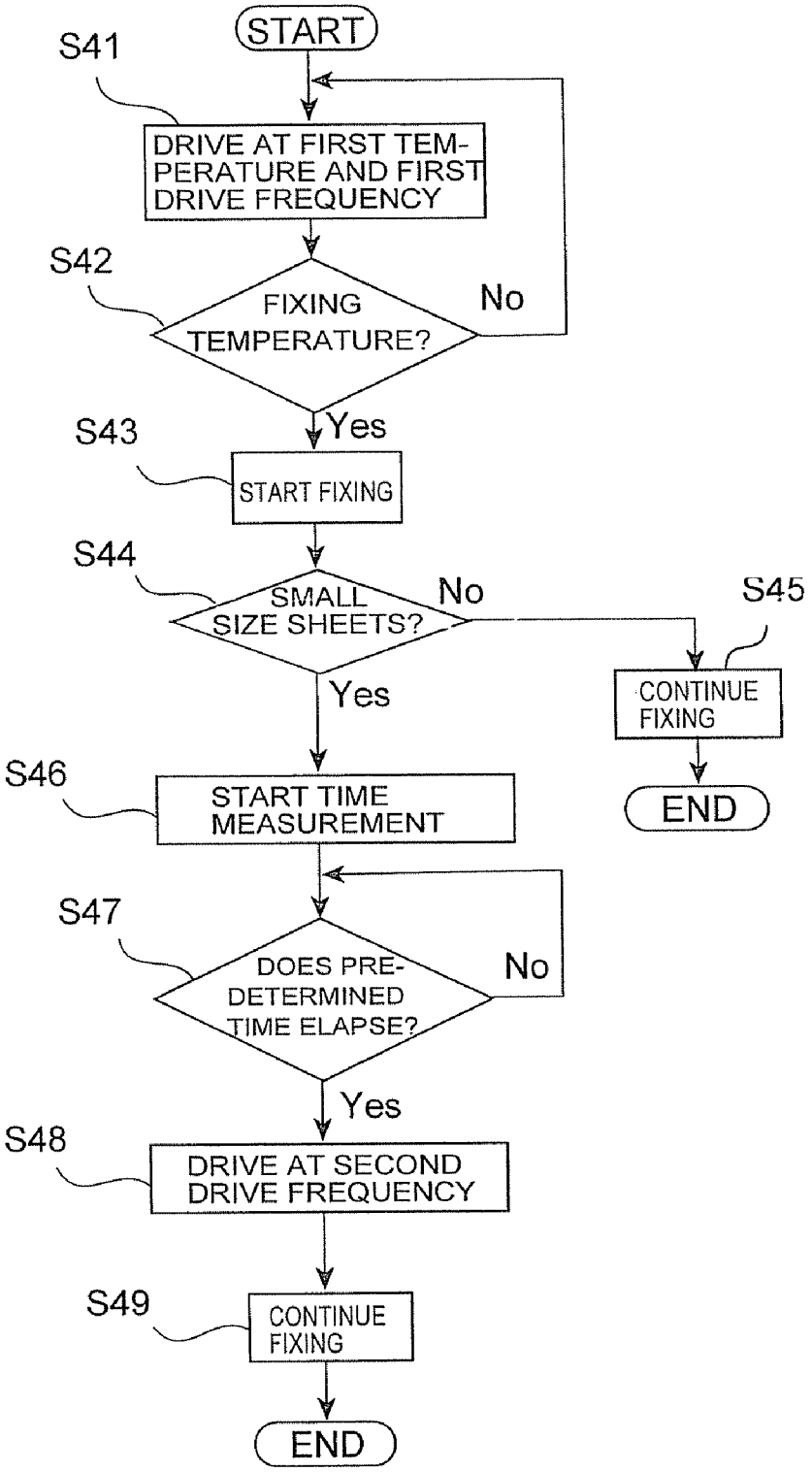
FIG. 17 is a flow chart showing yet a further example of temperature control of the heat roller as Embodiment 6 of heating control.

FIG. 17 is a flow chart showing an example of temperature control of the heat roller of this embodiment. Further, Steps S41 to S45 are similar to Steps S1 to S5 shown in FIG. 10A and Steps S17 to S21 shown in FIG. 12A, so that the explanation for them will be omitted.

The control unit 60 judges whether the sheet size to be conveyed is a small size or not, for example, on the basis of an input instruction from the operation panel 5 or the PC 100 (Step S44). The timer 104 starts time measurement by an instruction of the control unit 60 (Step S46). Further, the control unit 60, on the basis of a signal from the temperature sensor 58A, controls the input power so as to keep the surface temperature of the central part 54 of the heat roller 40 at the fixing temperature 180° C. At the end part 56 where the small size sheets do not pass through, no heat is lost to the sheets, so that the temperature of the end part 56 rises.

The control unit 60, at Step S47, when judging that a predetermined period of time elapses from the start of time measurement, changes the drive frequency to the higher second drive frequency 40 to 60 kHz, for example, 50 kHz, drives the inverter circuit 76 (Step S48), and continues the fixing operation (Step S49). Further, for the predetermined time for switching the drive frequency to the second drive frequency, for example, the time from start of image formation of small size sheets or detection of the small size sheets by the sheet detector 102 until the temperature of the end part 56 becomes the second temperature which is higher than the temperature $T_{TH}$ conforming to Formula 6 may be obtained beforehand from experimentation or calculation and stored in the memory.

According to the fixing device 34 of Embodiment 6 aforementioned, when the small size sheets pass continuously, the inverter circuit 76 is driven at the second drive frequency higher than the first drive frequency, so that the current flowing in the current supply circuit can be used within the normal current range. Therefore, the power is supplied stably without interrupting the power supply of the inverter circuit 76 and the fixing can be continued.

Further, in the embodiment aforementioned, the embodiment for changing largely the first drive frequency to the second drive frequency is cited, though the present invention is not limited to it. For example, it is possible to feed back a signal from the temperature sensor 58B or the current detection unit 92 and increase the frequency slowly or stepwise.

Further, as a constitution of the fixing device 34 of the embodiment aforementioned, a constitution that the nip portion where toner is fixed is formed by pressurizing the pressing roller 42 to the heat roller 40 is cited, though the present invention is not limited to it. For example, at the position where the pressing roller 42 is shifted from the heat roller 40, by pressurizing the pressing roller 42 to the belt 46 heated by the heat roller 40, the nip portion may be formed. Further, without using the belt 46, the heat roller 40 and pressing roller 42 may directly form the nip portion.

Further, the present invention is not limited to the embodiments aforementioned and within a range which is not deviated from the objects of the present invention, the embodiments can be modified and combined variously, thereby can be executed.

According to the present invention, a fixing device for using a degaussing alloy as an electromagnetic induction heat generation member in a wide temperature region and supplying stably power to an exciting member can be provided.

What is claimed is:

1. A fixing device comprising:

a permeable member having a predetermined thickness;

an induction heating member configured to excite the permeable member to generate an eddy current in the permeable member;

a current supply circuit configured to supply an AC current to the induction heating member; and a control unit, when temperatures of a first portion and a second portion of the permeable member are a first temperature lower than a temperature $T_{TH}$ conforming to the following formula:

$$d = \sqrt{\frac{2\rho}{\omega_1 \mu_{(T_{TH})}}}$$

where d: a thickness [m] of the permeable member,

ρ: a resistivity [Ω·m] of the permeable member, ($\omega_1$): an angular frequency [rad/s] of a first drive frequency, and μ: a permeability [H/m] of the permeable member, configured to control so as to permit the current supply circuit to supply the AC current at the first drive frequency to the induction heating member, and when the temperature of the second portion of the permeable member excited at the first drive frequency is a second temperature higher than the temperature $T_{TH}$, to control so as to permit the current supply circuit to supply the AC current which conforms to the following formula:

$$d < \sqrt{\frac{2\rho}{\omega_2 \mu_{(T_2)}}}$$

where $\omega_2$: an angular frequency [rad/s] of a second drive frequency and flows at the second drive frequency higher than the first drive frequency to the induction heating member.

2. The device according to claim 1, wherein the control unit, when the temperature of the second portion of the permeable member excited at the second drive frequency lowers and becomes a temperature lower than a temperature $T_{TH}'$ conforming to the following formula:

$$d = \sqrt{\frac{2\rho}{\omega_2 \mu_{(T'_{TH})}}}$$

where $T_{TH}' \leqq T_{TH}$ controls so as to permit the current supply circuit to supply the AC current at a third drive frequency lower than the second drive frequency to the induction heating member.

3. The fixing device according to claim 1 further comprising:

a first temperature detection member configured to detect a temperature of the first portion of the permeable member; and a second temperature detection member configured to detect a temperature of the second portion of the permeable member, wherein the control unit, on the basis of the temperatures detected by the first and second temperature detection members, permits the current supply circuit to supply the AC current at the first drive frequency or the second drive frequency to the induction heating member.

4. The device according to claim 3, wherein the control unit, when the temperature of the second portion, detected by the second temperature detection member, of the permeable member excited at the second drive frequent does not lower than a temperature when the first drive frequency is switched to the second drive frequency, judges whether the second drive frequency can be increased within a range conforming to the following formula:

$$d < \sqrt{\frac{2\rho}{\omega_x \mu_{(T_2)}}}$$

where $\omega_x$: an angular frequency [rad/s] at a drive frequency higher than the second drive frequency or not and when it can be increased, until the temperature detected by the second temperature detection member lowers to lower than a temperature when the first drive frequency is switched to the second drive frequency, controls so as to increase the second drive frequency within a possible range.

5. The device according to claim 1 further comprising:

a belt member wound and suspended round the permeable member;

a first temperature detection, member configured to detect a temperature of the belt member corresponding to the first portion of the permeable member; and a second temperature detection member configured to detect a temperature of the belt member corresponding to the second portion of the permeable member, wherein the control unit, on the basis of the temperature of the belt detected by the first and second temperature detection members, permits the current supply circuit to supply the AC current at the first drive frequency or the second drive frequency to the induction heating member.

6. The device according to claim 1 further comprising:

a current detection member configured to detect a magnitude of the AC current, wherein the control unit, when a current detected by the current detection member is a first current flowing when the temperatures of the first and second portions of the permeable member is the first temperature, controls so as to permit the current supply circuit to supply the AC current at the first drive frequency to the induction heating member and when the current detected by the current detection member is a second current flowing when the temperature of the second portion of the permeable member excited at the first drive frequency is a second temperature higher than the temperature $T_{TH}$, controls so as to permit the current supply circuit to supply the AC current at the second drive frequency to the induction heating member.

7. The device according to claim 6, wherein the control unit, when the AC current at the second drive frequency detected by the current detection member is reduced to a third current lower than the second current, controls so as to permit the current supply circuit to supply the AC current at a third drive frequency lower than the second drive frequency to the induction heating member.

8. The device according to claim 6, wherein the control unit, when the AC current at the second drive frequency detected by the current detection member is not reduced to lower than the second current, judges whether the second drive frequency can be increased within a range conforming to the following formula:

$$d < \sqrt{\frac{2\rho}{\omega_x \mu_{(T_2)}}}$$

where $\omega_x$: an angular frequency [rad/s] at a drive frequency higher than the second drive frequency or not and when it can be increased, until the current detected by the current detection member is reduced to lower than the second current, controls so as to increase the second drive frequency within a possible range.

9. The device according to claim 1, wherein the second portion is a portion where no sheets pass.

10. An image forming apparatus comprising:

an image forming unit configured to form an image on a sheet;

a permeable member having a predetermined thickness;

an induction heating member configured to excite the permeable member to generate an eddy current in the permeable member;

a current supply circuit configured to supply an AC current to the induction heating member; and a control unit, when temperatures of a first portion and a second portion of the permeable member are a first temperature lower than a temperature $T_{TH}$ conforming to the following formula:

$$d = \sqrt{\frac{2\rho}{\omega_1 \mu_{(T_{TH})}}}$$

where d: a thickness [m] of the permeable member,

ρ: a resistivity [Ω·m] of the permeable member, ($\omega_1$): an angular frequency [rad/s] of a first drive frequency, and μ: a permeability [H/m] of the permeable member, configured to control so as to permit the current supply circuit to supply the AC current at the first drive frequency to the induction heating member, and when the temperature of the second portion of the permeable member excited at the first drive frequency is a second temperature higher than the temperature $T_{TH}$, to control so as to permit the current supply circuit to supply the AC current which conforms to the following formula:

$$d < \sqrt{\frac{2\rho}{\omega_2 \mu_{(T_2)}}}$$

where $\omega_2$: an angular frequency [rad/s] of a second drive frequency and flows at the second drive frequency higher than the first drive frequency to the induction heating member.

11. The apparatus according to claim 10, wherein the control unit, when the temperature of the second portion of the permeable member excited at the second drive frequency lowers and becomes a temperature lower than a temperature $T_{TH}'$ conforming to the following formula:

$$d = \sqrt{\frac{2\rho}{\omega_2 \mu_{(T'_{TH})}}}$$

where $T_{TH}' \leqq T_{TH}$ controls so as to permit the current supply circuit to supply the AC current at a third drive frequency lower than the second drive frequency to the induction heating member.

12. The apparatus according to claim 10 further comprising:

a first temperature detection member configured to detect a temperature of the first portion of the permeable member; and a second temperature detection member configured to detect a temperature of the second portion of the permeable member, wherein the control unit, on the basis of the temperatures detected by the first and second temperature detection members, permits the current supply circuit to supply the AC current at the first drive frequency or the second drive frequency to the induction heating member.

13. The apparatus according to claim 12, wherein the control unit, when the temperature of the second portion, detected by the second temperature detection member, of the permeable member excited at the second drive frequent does not lower than a temperature when the first drive frequency is switched to the second drive frequency, judges whether the second drive frequency can be increased within a range conforming to the following formula:

$$d < \sqrt{\frac{2\rho}{\omega_x \mu_{(T_2)}}}$$

where $\omega_x$: an angular frequency [rad/s] at a drive frequency higher than the second drive frequency or not and when it can be increased, until the temperature detected by the second temperature detection member lowers to lower than a temperature when the first drive frequency is switched to the second drive frequency, controls so as to increase the second drive frequency within a possible range.

14. The apparatus according to claim 10 further comprising:

a belt member wound and suspended round the permeable member;

a first temperature detection member configured to detect a temperature of the belt member corresponding to the first portion of the permeable member; and a second temperature detection member configured to detect a temperature of the belt member corresponding to the second portion of the permeable member, wherein the control unit, on the basis of the temperature of the belt detected by the first and second temperature detection members, permits the current supply circuit to supply the AC current at the first drive frequency or the second drive frequency to the induction heating member.

15. The apparatus according to claim 10 further comprising:

a current detection member configured to detect a magnitude of the AC current, wherein the control unit, when a current detected by the current detection member is a first current flowing when the temperatures of the first and second portions of the permeable member is the first temperature, controls so as to permit the current supply circuit to supply the AC current at the first drive frequency to the induction heating member and when the current detected by the current detection member is a second current flowing when the temperature of the second portion of the permeable member excited at the first drive frequency is a second temperature higher than the temperature $T_{TH}$, controls so as to permit the current supply circuit to supply the AC current at the second drive frequency to the induction heating member.

16. The apparatus according to claim 15, wherein the control unit, when the AC current at the second drive frequency detected by the current detection member is reduced to a third current lower than the second current, controls so as to permit the current supply circuit to supply the AC current at a third drive frequency lower than the second drive frequency to the induction heating member.

17. The apparatus according to claim 15, wherein the control unit, when the AC current at the second drive frequency detected by the current detection member is not reduced to lower than the second current, judges whether the second drive frequency can be increased within a range conforming to the following formula:

$$d < \sqrt{\frac{2\rho}{\omega_x \mu_{(T_2)}}}$$

where $\omega_x$: an angular frequency [rad/s] at a drive frequency higher than the second drive frequency or not and when it can be increased, until the current detected by the current detection member is reduced to lower than the second current, controls so as to increase the second drive frequency within a possible range.

18. The apparatus according to claim 10, wherein the second portion is a portion where no sheets pass.

19. A heating control method for a fixing device including a permeable member having a predetermined thickness, an induction heating member configured to excite the permeable member to generate an eddy current in the permeable member, and a current supply circuit configured to supply an AC current to the induction heating member, comprising:

supplying the AC current at a first drive frequency for the induction heating member to the current supply circuit when temperatures of a first portion and a second portion of the permeable member are a first temperature lower than a temperature $T_{TH}$ conforming to the following formula:

$$d = \sqrt{\frac{2\rho}{\omega_1 \mu_{(T_{TH})}}}$$

where d: a thickness [m] of the permeable member,

ρ: a resistivity [Ω·m] of the permeable member, $(\omega_1)$: an angular frequency [rad/s] of a first drive frequency, and μ: a permeability [H/m] of the permeable member, configured to control so as to permit the current supply circuit to supply the AC current at the first drive frequency to the induction heating member, and when the temperature of the second portion of the permeable member excited at the first drive frequency is a second temperature higher than the temperature $T_{TH}$, to control so as to permit the current supply circuit to supply the AC current which conforms to the following formula:

$$d < \sqrt{\frac{2\rho}{\omega_2 \mu_{(T_2)}}}$$

where $\omega_2$: the angular frequency [rad/s] of the second drive frequency and flows at the second drive frequency higher than the first drive frequency to the current supply circuit when the temperature of the second portion of the permeable member excited at the first drive frequency is a second temperature higher than the temperature $T_{TH}$.

20. The method according to claim 19 further comprising:

supplying the AC current at a third drive frequency lower than the second drive frequency for the induction heating member to the current supply circuit when the temperature of the second portion of the permeable member excited at the second drive frequency lowers and becomes a temperature lower than a temperature $T_{TH}'$ conforming to the following formula:

$$d = \delta = \sqrt{\frac{2\rho}{\omega_2 \mu_{(T'_{TH})}}}$$

where $T_{TH}' \leqq T_{TH}$.

21. A fixing device comprising:

a permeable member;

an induction heating member which excites the permeable member to generate an eddy current in the permeable member;

a current supply circuit which supplies an AC current to the induction heating member; and a control unit, if a temperature of an end of the permeable member is higher than a predetermined temperature, which controls so as to permit the current supply circuit to supply an AC current at a first drive frequency higher than a second drive frequency of the AC current which is supplied to the current supply circuit if the temperature of the end of the permeable member is lower than the predetermined temperature.

22. The fixing device according to claim 21, the predetermined temperature being Curie temperature.

23. A fixing method comprising:

supplying an AC current to an induction heating member to excite a permeable member and generate an eddy current in the permeable member;

judging whether the temperature of the end part of the permeable member is higher than a predetermined temperature; and supplying, if judged as the temperature of the end part of the permeable member is higher than the predetermined temperature, an AC current to the induction heating member at a first drive frequency higher than a second drive frequency of the AC current which is supplied to the induction heating member if the temperature of the end part of the permeable member is lower than the predetermined temperature.

24. The fixing method according to claim 23, the predetermined temperature being Curie temperature.

* * * * *